US010811754B2

(12) United States Patent
Wang et al.

(10) Patent No.: US 10,811,754 B2
(45) Date of Patent: Oct. 20, 2020

(54) POWER COUPLERS AND RELATED DEVICES HAVING ANTENNA ELEMENT POWER ABSORBERS

(71) Applicant: CommScope Technologies LLC, Hickory, NC (US)

(72) Inventors: Huan Wang, Richardson, TX (US); Michael Brobston, Allen, TX (US)

(73) Assignee: CommScope Technologies LLC, Hickory, NC (US)

( * ) Notice: Subject to any disclaimer, the term of this patent is extended or adjusted under 35 U.S.C. 154(b) by 55 days.

(21) Appl. No.: 16/157,679

(22) Filed: Oct. 11, 2018

(65) Prior Publication Data

US 2019/0115644 A1 Apr. 18, 2019

Related U.S. Application Data

(60) Provisional application No. 62/571,822, filed on Oct. 13, 2017.

(51) Int. Cl.

| | |
|---|---|
| ***H01P 5/18*** | (2006.01) |
| ***H01P 1/26*** | (2006.01) |
| ***H01P 5/20*** | (2006.01) |
| ***H01P 1/213*** | (2006.01) |
| ***H01P 3/12*** | (2006.01) |

(52) U.S. Cl.

CPC ..... *H01P 5/184* (2013.01); *H01P 1/2133* (2013.01); *H01P 3/121* (2013.01); *H01P 5/181* (2013.01); *H01P 5/182* (2013.01); *H01P 5/183* (2013.01); *H01P 5/188* (2013.01); *H01P 5/20* (2013.01)

(58) Field of Classification Search

CPC .... H01P 5/16; H01P 5/18; H01P 5/181; H01P 1/26

USPC ..... 333/116, 239

See application file for complete search history.

(56) References Cited

U.S. PATENT DOCUMENTS

| | | | | |
|---|---|---|---|---|
| 4,240,155 | A | 12/1980 | Vaughan | |
| 7,973,616 | B2 | 7/2011 | Shijo et al. | |
| 8,669,834 | B2 * | 3/2014 | Cheng | H01P 3/121 29/600 |
| 9,136,579 | B2 * | 9/2015 | Lee | H01P 1/182 |
| 9,548,526 | B2 | 1/2017 | Lu et al. | |
| 2010/0148886 | A1 | 6/2010 | Inoue et al. | |

(Continued)

FOREIGN PATENT DOCUMENTS

| | | |
|---|---|---|
| CN | 101242027 | 8/2008 |
| JP | 2007266509 A | * 10/2007 |
| WO | 2009/095815 | 8/2009 |

OTHER PUBLICATIONS

Carrera et al. "Compact Substrate Integrated Waveguide Directional Couplers in Ku and K Bands" Proceedings of the 40th European Microwave Conference (pp. 1178-1181) (Sep. 2010).

(Continued)

*Primary Examiner* — Dean O Takaoka

(74) *Attorney, Agent, or Firm* — Myers Bigel, P.A.

(57) ABSTRACT

A power coupler includes an input port, first and second output ports and an antenna element that is electrically coupled between the first output port and the second output port or that is electrically coupled to an isolation port of the power coupler. The power coupler is configured to split a radio frequency signal incident at the input port and/or to combine radio signals incident at the respective first and second output ports.

20 Claims, 12 Drawing Sheets

(56) References Cited

U.S. PATENT DOCUMENTS

2015/0340765 A1* 11/2015 Dang ..... H01Q 21/0075
343/893
2016/0336638 A1* 11/2016 Dang ..... H01P 5/02

OTHER PUBLICATIONS

Geng et al. "Single Microstrip Layer Holds UWB Log-Periodic Antenna" Microwaves & RF (pp. 106-112) (Apr. 2015).
Lin et al. "Development of a Novel UWB Vivaldi Antenna Array Using SIW Technology" Progress in Electromagnetics Research 90:369-384 (2009).
Rahali et al. "Substrate Integrated Waveguide Power Divider, Circulator and Coupler in [10-15] GHz Band" International Journal of Information Sciences and Techniques (IJIST) 4(1/2):1-11 (Mar. 2014).
Toreinia et al. "Design and Tuning of Wideband Two-layer Substrate Integrated Waveguide Directional Couplers" 6th International Symposium on Telecommunications (IST) (pp. 70-74) (Nov. 2012).
Notification of Transmittal of the International Search Report and the Written Opinion of the International Searching Authority, or the Declaration, in corresponding PCT Application No. PCT/US2018/055360 (15 pages) (dated Jan. 23, 2019).
Son et al. "Design of a circularly polarised radio-frequency identification reader antenna with high return loss" IET Microwaves, Antennas & Propagation 5(15):1844-1848 (Dec. 9, 2011).

* cited by examiner

POWER COUPLERS AND RELATED DEVICES HAVING ANTENNA ELEMENT POWER ABSORBERS

CROSS-REFERENCE TO RELATED APPLICATION

The present application claims priority under 35 U.S.C. § 119 to U.S. Provisional Patent Application Ser. No. 62/571,822, filed Oct. 13, 2017, the entire content of which is incorporated herein by reference as if set forth in its entirety.

FIELD

The inventive concepts described herein relate to power couplers and, more particularly, to power couplers that include power absorbing elements.

BACKGROUND

Wireless radio frequency ("RF") communications systems, such as cellular communications systems, WiFi systems and the like, are known in the art. There has been a rapid increase in the demand for wireless communications, with many new applications being proposed in which wireless communications will replace communications that were previously carried over copper or fiber optic communications cables. Most conventional wireless communications systems operate at frequencies below 6.0 GHz, with notable exceptions that include microwave backhaul systems and various military applications. As capacity requirements continue to increase, the use of higher frequencies is being considered for many applications. As higher frequencies are considered, the millimeter wave spectrum, which includes frequencies from approximately 25 GHz to as high as about 300 GHz, is a potential candidate, as there are large contiguous frequency bands in this frequency range that are potentially available for new applications.

Free space loss generally increases with increasing frequency, and hence losses may be very high when communicating at millimeter wave frequencies. These losses can be offset by using highly directional antenna beams that exhibit high gain levels on the transmit and/or receive antennas of the wireless communication system. In order to generate highly directional antenna beams, it is typically necessary to use either large parabolic dish antennas or phased array antennas that have multiple rows and columns of radiating elements with full phase distribution control. When beam-steering is also required (i.e., the ability to quickly redirect the antenna beam), phased array antennas are typically used.

Phased array antennas form a highly directional antenna beam by dividing an RF signal into sub-components, adjusting the magnitude and/or phase of the sub-components in a manner that will cause the sub-components to constructively or "coherently" combine in a desired direction, and then transmitting these sub-components through the respective antenna elements. While high levels of coherent combining are theoretically possible, the actual performance of a phased array antenna will typically fall short of the theoretical performance because the electronic components of the communications system will not have perfect impedance matches with one another, perfect isolation and/or perfect magnitude and phase adjustments. These imperfections can dramatically decrease the actual performance levels from the theoretically achievable performance levels. Thus, it may be important to design and manufacture high performance components to maintain high performance levels, particularly for millimeter wave (and higher frequency) wireless communications systems.

SUMMARY

Pursuant to embodiments of the present invention, power couplers are provided that include an input port, a first output port, a second output port and an antenna element that is electrically coupled between the first output port and the second output port or that is electrically coupled to an isolation port of the power coupler. These power couplers are configured to split an RF signal incident at the input port and/or to combine radio signals incident at the respective first and second output ports.

In some embodiments, the antenna element may be a patch radiating element.

In some embodiments, the power coupler may be a four port power coupler, and the antenna element may be electrically coupled to the isolation port.

In some embodiments, power coupler may be a three port power coupler, and the antenna element may be electrically coupled between the first output port and the second output port.

In some embodiments, the power coupler may be implemented in a printed circuit board that includes a dielectric substrate, a conductive ground plane on a first surface of the dielectric substrate and a conductive pattern on a second surface of the dielectric substrate that is opposite the first surface. In such embodiments, at least a portion of the power coupler may be implemented as a substrate integrated waveguide power coupler that includes an array of plated through holes that connect the conductive ground plane to the conductive pattern. In other embodiments, at least a portion of the power coupler may be implemented as a coplanar waveguide that includes an array of plated vias that connect the conductive ground plane to first and second ground portions of the conductive pattern, and/or the conductive pattern may further include a conductive track that is separated from the first and second ground portions by respective first and second gaps.

In some embodiments, the antenna element may be implemented in the printed circuit board.

In some embodiments, the antenna element may be configured to function as a power absorber for RF signals in an operating frequency band of the power coupler.

In some embodiments, the power coupler may be configured to operate on millimeter wave signals.

In some embodiments, the patch radiating element may include a patch radiator that is part of the conductive pattern, and the patch radiator may have an inset feed.

In some embodiments, at least one of the input port, the first output port and the second output port may be a co-planar waveguide.

In some embodiments, the antenna element may be a patch radiating element, a horn radiating element or a slot radiating element.

In some embodiments, the power coupler may be provided in combination with first and second filters that are coupled to the respective first and second output ports, and a second power coupler that is coupled to the first and second filters opposite the power coupler. In such embodiments, the combination of the power coupler, the second power coupler and the first and second filters may comprise a balanced filter.

In some embodiments, the power coupler may be provided in combination with first and second amplifiers that are coupled to the respective first and second output ports and a second power coupler that is coupled to the first and second amplifiers opposite the power coupler. In such embodiments, the combination of the power coupler, the second power coupler and the first and second amplifiers may comprise a balanced amplifier.

In some embodiments, the patch radiating element may have first and second inset feeds.

Pursuant to further embodiments of the present invention, printed circuit board structures are provided that include a dielectric substrate having a first surface and a second surface opposite the first surface, a conductive ground plane on the first surface of the dielectric substrate, and a conductive pattern on the second surface of the dielectric substrate, the conductive pattern including an antenna element. A power coupler that includes an input port, a first output port and a second output port is integrated within the printed circuit board structure. The antenna element is coupled between the first output port and the second output port or is coupled to an isolation port of the power coupler.

In some embodiments, the antenna element may be a patch radiating element. The patch radiating element may be implemented in the printed circuit board. The printed circuit board structure may be a stripline printed circuit board. The patch radiating element may include a patch radiator that is part of the conductive pattern, and the patch radiator may have an inset feed. In some embodiments, the patch radiating element may have first and second inset feeds. In other embodiments, the antenna element may be a slot radiating element.

In some embodiments, the power coupler may be a four port power coupler, and the antenna element may be electrically coupled to the isolation port.

In some embodiments, the power coupler may be a three port power coupler, and the antenna element may be electrically coupled between the first and second output ports.

In some embodiments, at least a portion of the power coupler may be implemented as a substrate integrated waveguide that includes an array of plated through holes that connect the conductive ground plane to the conductive pattern.

In some embodiments, at least a portion of the power coupler may be implemented as a co-planar waveguide that includes an array of plated vias that connect the conductive ground plane to first and second ground portions of the conductive pattern, and the conductive pattern may further include a conductive track that is separated from the first and second ground portions by respective first and second gaps.

Pursuant to still further embodiments of the present invention, substrate integrated waveguide power couplers are provided that include an input port, a first output port, a second output port, an isolation port, a coupling region that is between the input port and the first and second output ports and that is between the isolation port and the first and second output ports, and an antenna element that is electrically coupled to the isolation port opposite the first and second output ports. The power coupler is configured to split an RF signal incident at the input port and/or to combine radio signals incident at the respective first and second output ports. The antenna element may be, for example, a patch radiating element, a horn radiating element or a slot radiating element.

In some embodiments, the power coupler may be implemented in a printed circuit board that includes a dielectric substrate, a conductive ground plane on a first surface of the dielectric substrate and a conductive pattern on a second surface of the dielectric substrate that is opposite the first surface, and first and second rows of plated holes that connect the conductive ground plane to the conductive pattern, the first and second rows of plated holes lining respective first and second sides of the coupling region. In such embodiments, the input port, the first and second output ports may each be implemented as co-planar waveguides.

DETAILED DESCRIPTION

Printed circuit board based RF devices are increasingly being used due to their low cost, small size, light weight and relatively simple fabrication. Printed circuit board based RF devices may have RF transmission lines and/or RF components implemented in the printed circuit board structure, and may also have surface mount components such as integrated circuit chips and/or other circuit elements mounted on the printed circuit board structure. One potential difficulty with printed circuit board based RF devices is that as RF applications move to higher frequencies, such as millimeter wave and higher frequencies, the wavelength of the RF signals becomes increasingly smaller. As the wavelength is reduced, it may become difficult to fabricate components having precise dimensions in terms of the wavelength of the RF signals (e.g., dimensions of λ/4) due to fabrication tolerances. Difficulties may also arise because the length and/or height of various surface mount components may become too close in size to the length of a quarter wavelength of the RF signal. By way of example, in a 28 GHz millimeter wave application, a quarter wavelength transmission line in a typical printed circuit board substrate may have a length of about 1.6 mm. A state-of-the-art surface mount resistor may have a length and height on the order of 0.5 mm or larger, which is close enough in size to a quarter wavelength of the RF signal such that parasitic effects will arise. In other words, the resistor (along with its soldered leads) will not act like a pure resistor, but instead may have a relatively large reactance value that may degrade the impedance match between the resistor and a transmission line that the resistor is connected to, resulting in an increase in the return loss. Additionally, as the resistor becomes close in size to a quarter wavelength of the RF signal, the resistor may start to radiate significant power. Another potential difficulty is that soldering a 0.5 mm resistor to a printed circuit board may require special soldering techniques and/or equipment, which may increase production costs.

Figure 1A:
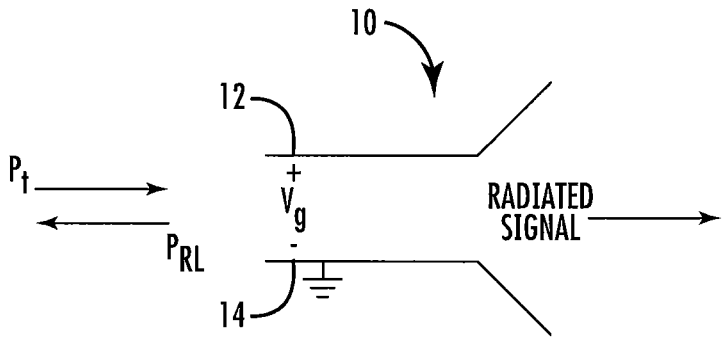
FIG. 1A is a schematic diagram of a patch radiating element.
Figure 1B:
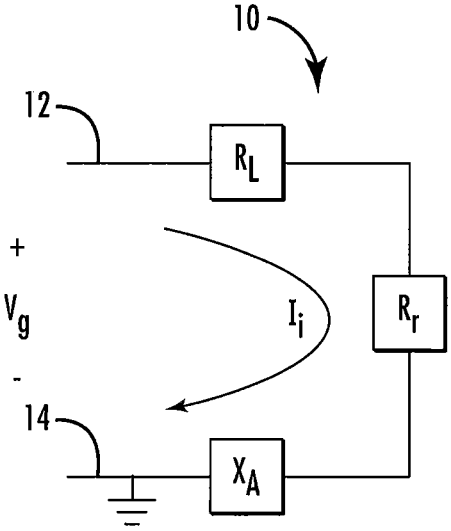
FIG. 1B is an equivalent circuit diagram of the patch radiating element of FIG. 1A.

FIG. 1A is a schematic diagram of an antenna element 10 such as, for example, a patch radiating element. FIG. 1B is an equivalent circuit diagram for the antenna element 10 of FIG. 1A. Referring to FIGS. 1A-1B, the impedance of the antenna element 10 is the impedance presented at the input terminals 12, 14 of antenna element 10. The ratio of the voltage $V_g$ across input terminals 12, 14 to the current $I_I$ flowing through the antenna element 10 defines the impedance $Z_A$ of the antenna element 10 as:

$$Z_A R_A + jX_A \tag{1}$$

where:

$Z_A$=the impedance (in ohms) of the antenna element 10 at terminals 12, 14;

$R_A$=the resistance (in ohms) of the antenna element 10 at terminals 12, 14; and $X_A$=the reactance (in ohms) of the antenna element 10 at terminals 12, 14.

The resistive portion $R_A$ in Equation (1) includes both the radiation resistance $R_r$ of the antenna element 10 and the loss resistance $R_L$ of the antenna element 10, and may be defined as:

$$R_A = R_r + R_L \tag{2}$$

Referring to FIG. 1B, $V_g$ represents the voltage across terminals 12, 14 and $I_I$ represents the current flowing between terminals 12, 14. Under the condition of conjugate matching, the power $P_r$ delivered to the antenna element 10 for radiation is:

$$Pr = \frac{|Vg|^2}{2}\left[\frac{Rr}{(Rr+RL)^2}\right] \tag{3}$$

The power $P_L$ that is dissipated as heat is given by:

$$PL = \frac{|Vg|^{2i}}{2}\left[\frac{RL}{(Rr+RL)^2}\right] \tag{4}$$

Thus, under the condition of conjugate matching, the total power delivered to the antenna element 10 is:

$$P_r + P_L = \frac{|Vg|^{2i}}{2}\frac{1}{Rr+RL} \tag{5}$$

It is generally not possible to perfectly implement conjugate matching, and hence power $P_{RL}$ will be reflected back from terminals 12, 14, as shown in FIG. 1A. The total power $P_t$ excited at a source is the sum of the three above-discussed power components:

$$P_t = P_{RL} + P_r + P_L \tag{6}$$

Figure 2:
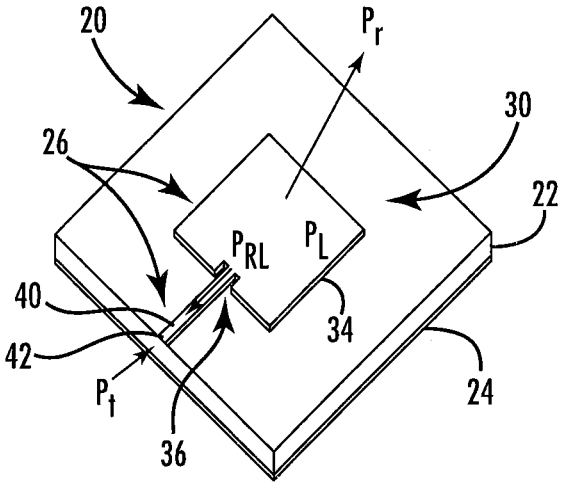
FIG. 2 is a schematic perspective view of a printed circuit board that includes a microstrip transmission line and a patch radiating element formed therein.

Microstrip is a well known type of RF transmission line that may be implemented using printed circuit board technology. RF components such as antenna elements, power couplers and the like may also be implemented in a printed circuit board, and surface mount components such as integrated circuits and/or circuit elements may be mounted (e.g., by soldering) on a printed circuit board. FIG. 2 is a schematic perspective view of a printed circuit board 20 that includes a microstrip transmission line 40 and an antenna element in the form of a patch radiating element 30 formed therein.

As shown in FIG. 2, the printed circuit board 20 includes a dielectric substrate 22 having first and second opposed major surfaces. A metal layer 24 is provided on the first (lower) surface of the dielectric substrate 22 that may act as a ground plane layer 24. A metal pattern 26 is provided on the second (upper) surface of the dielectric substrate 22. The metal pattern 26 includes a patch radiator 34 and a transmission line trace 40. The patch radiator 34 is part of a patch radiating element 30 that includes the patch radiator 34 and the portions of the dielectric substrate 22 and the ground plane layer 24 that are underneath the patch radiator 34. The patch radiator 34 has an inset feed design and hence has a feed point 36 where the transmission line 40 connects to the patch radiator 34 that is inset from an edge of the patch radiator 34. The printed circuit board 20 may be formed by forming metal layers on the first and second opposed surfaces of dielectric substrate 22 and then etching the metal layer on the second surface to form the metal pattern 26 having the transmission line 40 and inset-fed patch radiator 34.

When an RF signal having power $P_t$ is applied to a first end 42 of the transmission line 40, a first portion $P_r$ of the power $P_t$ is passed along the transmission line 40 to the patch radiating element 30 where it is radiated by the patch radiating element 30. A second portion $P_L$ of the power $P_t$ is delivered to the patch radiating element 30 but is dissipated within the patch radiating element 30 (e.g., as heat). A third portion $P_{RL}$ of the power $P_t$ is reflected by the patch radiating element 30 back along the transmission line 40.

Figure 3:
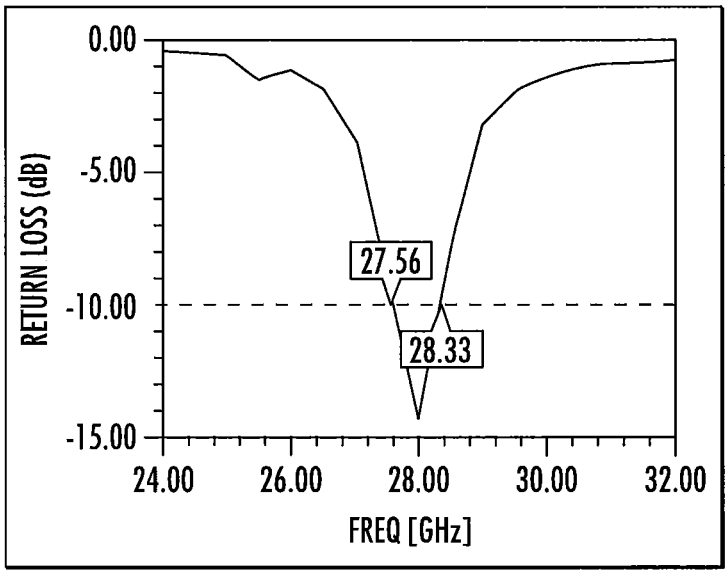
FIG. 3 is a graph illustrating the return loss as a function of frequency for the patch radiating element of FIG. 2.

FIG. 3 is a graph illustrating the return loss of the patch radiating element 30 of FIG. 2 (i.e., the percentage of power $P_{RL}$ reflected back down the transmission line) as a function of frequency. As known in the art, the return loss for a circuit element is equal to $10*\log_{10}(P_{RL}/P_t)$, where $P_t$ is the total power input to the circuit element and $P_{RL}$ is the power that is reflected by the circuit element back to the input. The patch radiating element 30 is configured to radiate in the 28 GHz frequency band, and hence the return loss value is lowest in this region (i.e., $P_{RL}$ is low in this region and $P_r$ is high). As shown in FIG. 3, the −10 dB return loss bandwidth for the patch radiating element 30 is 28.33 GHz−27.56 GHz=0.77 GHz. The fractional 10 dB return loss bandwidth $BW_F$ may be computed as:

$$BW_F=2*[(28.33\text{ GHz}-27.56\text{ GHz})]/[(28.33\text{ GHz}+27.56\text{ GHz})]=2.75\% \quad (7)$$

Figure 4:
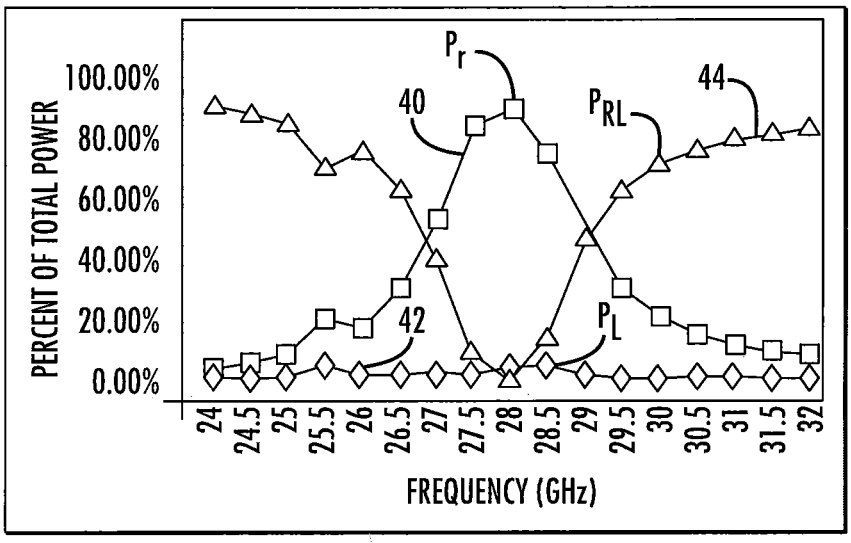
FIG. 4 is a graph with curves showing the components of the total power of a signal transmitted through the patch radiating element of FIG. 2 as a function of frequency.

FIG. 4 is a graph with curves 40, 42, 44 showing the respective percentages that $P_r$ and $P_L$ and $P_{RL}$ are of the total power $P_t$ as a function of frequency for the microstrip patch radiating element 30 of FIG. 3. As shown in FIG. 4, within the frequency band of 27.56-28.33 GHz, at least 90% of the power $P_t$ delivered over transmission line 40 to patch radiating element 30 is either radiated ($P_r$) or absorbed ($P_L$) by the patch radiating element 30. Thus, within this bandwidth, the patch radiating element 30 may act as a power absorber that "absorbs" (in the sense that it does not reflect backward) the vast majority of the RF power delivered thereto.

Figure 5A:
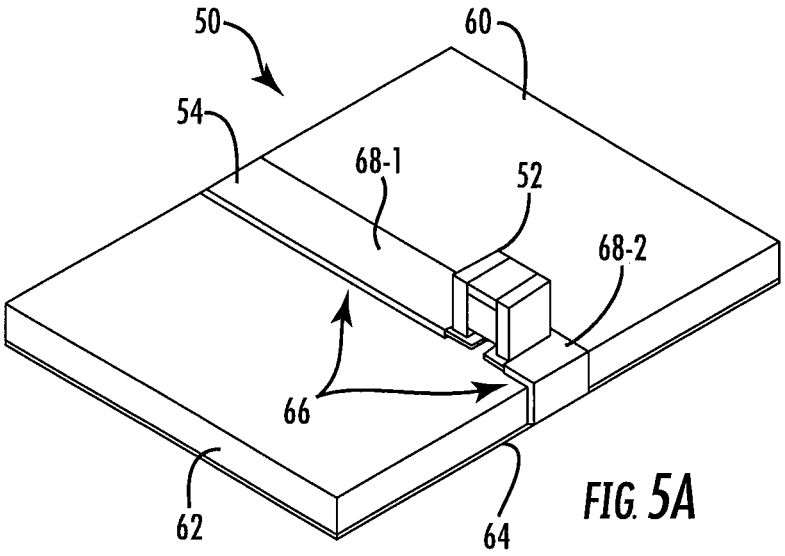
FIG. 5A is a schematic perspective diagram of a conventional microstrip resistive termination to ground.
Figure 5B:
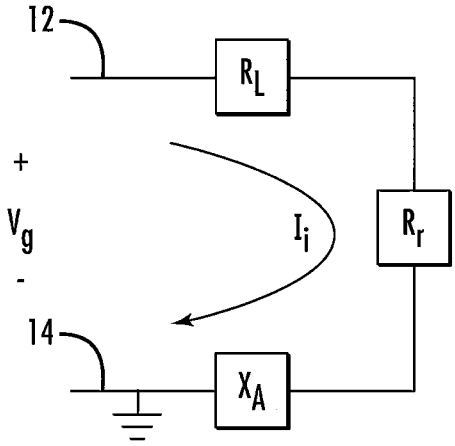
FIG. 5B is an equivalent circuit diagram of the conventional microstrip resistive termination to ground of FIG. 5A.

FIG. 5A is a schematic perspective view of a conventional microstrip resistive termination 50. FIG. 5B is an equivalent circuit diagram of the conventional microstrip resistive termination of FIG. 5A. As shown in FIG. 5A, the resistive termination 50 is implemented on a printed circuit board 60 that includes a dielectric substrate 62, a ground plane layer 64 on a lower surface of the dielectric substrate 62 and a metal pattern 66 on an upper surface of the dielectric substrate 62. The resistive termination 50 includes a resistor 52 that is connected as a surface mount component between a pair of transmission line segments 68-1, 68-2 that are part of the metal pattern 66. A first end of the first transmission line segment 68-1 may be connected to an input port 54, and the second end of the first transmission line segment 68-1 may be connected to the resistor 52. A first end of the second transmission line segment 68-2 may be connected to the resistor 52, and the second end of the second transmission line segment 68-2 may be short-circuited to the ground plane layer 64 so that the resistor 52 acts as a resistive termination to ground.

When an RF signal having power $P_t$ is input to input port 54, the power can be divided into three portions, namely first portion $P_r$ that is radiated by the resistor 52, a second portion $P_L$ that is the power that is dissipated within the resistor 52, and a third portion $P_{RL}$ that is reflected at the resistor 52 back down the transmission line 68-1. At 28 GHz, $P_r$ is relatively small (e.g., less than 5%) and $P_L$ is the dominant component. As can be seen by comparing FIG. 1B and FIG. 5B, the equivalent circuit for the patch radiating element 30 has the same elements as the equivalent circuit for the microstrip resistive termination 50.

Figure 6:
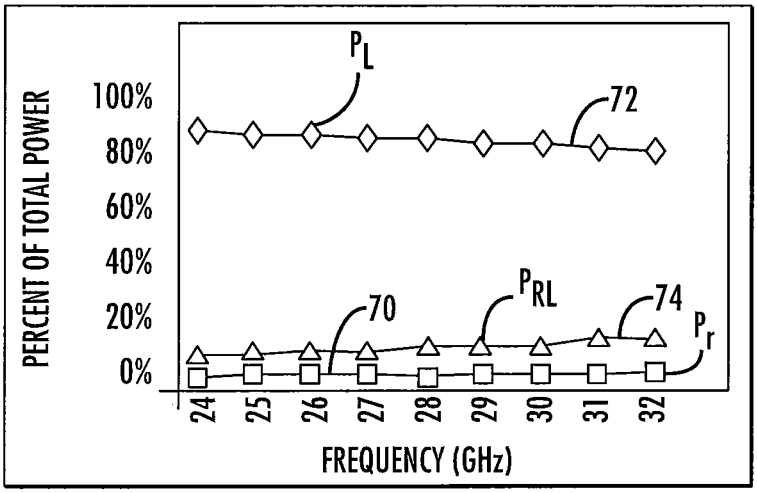
FIG. 6 is a graph with curves showing the components of the total power of a signal transmitted through the resistive termination of FIGS. 5A-5B.

FIG. 6 is a graph with curves 70, 72, 74 showing the respective percentages that $P_r$, $P_L$ and $P_{RL}$ are of the total power $P_t$ as a function of frequency for the resistive termination 50 of FIGS. 5A-5B. As shown in FIG. 6, within the frequency band of 27.56-28.33 GHz, at least 90% of the power delivered over transmission line 68-1 to resistor 52 either is radiated ($P_r$) by resistor 52 or is dissipated ($P_L$) by the resistor 52. Thus, the resistor 52 also acts like a power absorber. Thus, pursuant to embodiments of the present invention it may be realized that within the frequency band of interest, the resistor 52 and the patch radiating element 30 may be interchangeable when used as power absorbing elements, since the power absorbed by the resistor (i.e., $P_r+P_L$)≈the power absorbed by the antenna element ≈90% in the frequency band of interest Pursuant to embodiments of the present invention, RF power couplers are provided that use antenna elements such as, for example, patch radiating elements, slot radiating elements or horn radiating elements, in place of resistors. In some embodiments, the antenna elements may be used in place of resistive terminations to ground. In other embodiments, the antenna elements may be used as resistors that are interposed between two ports of the power couplers. The antenna elements may be designed to act as power absorbing devices that dissipate power input thereto.

In some embodiments, the RF power couplers may be implemented in printed circuit board structures to provide low cost, easy to assemble power couplers. In some embodiments, the RF power couplers may be designed to operate on millimeter wave signals such as 28 GHz and higher signals, as surface mount resistors may pose challenges at such high frequencies.

In one example embodiment, a power coupler is provided that includes an input port, first and second output ports and an antenna element that is electrically coupled between the first output port and the second output port or that is electrically coupled to an isolation port of the power coupler. The power coupler is configured to split a radio frequency signal incident at the input port and/or to combine RF signals incident at the respective first and second output ports.

In another example embodiment, a printed circuit board structure is provided that includes a dielectric substrate having a first surface and a second surface opposite the first surface, a conductive ground plane on the first surface of the dielectric substrate and a conductive pattern on the second surface of the dielectric substrate, the conductive pattern including an antenna element. A power coupler that includes an input port, a first output port and a second output port is integrated within the printed circuit board structure. The antenna element is coupled between the first output port and the second output port or is coupled to an isolation port of the power coupler.

In yet another example embodiment, a substrate integrated waveguide power coupler is provided that includes an input port, first and second output ports, an isolation port, and an antenna element that is electrically coupled to the isolation port opposite the first and second output ports. The power coupler is configured to split an RF signal incident at the input port and/or to combine RF signals incident at the respective first and second output ports.

Embodiments of the present invention will now be described in greater detail with reference to FIGS. 7-26.

Figure 7:
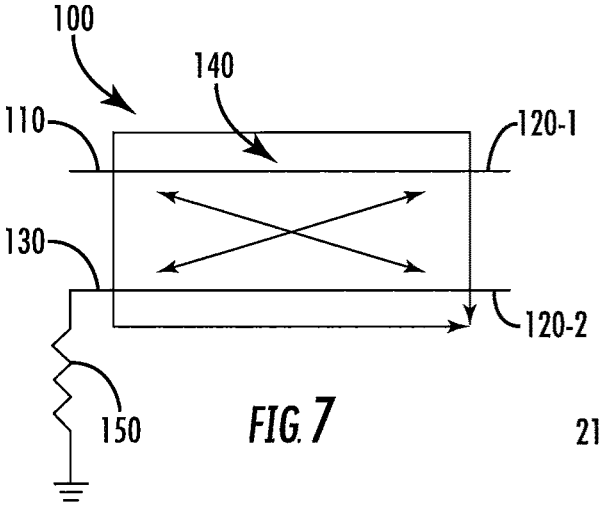
FIG. 7 is a circuit diagram of a conventional four-port power coupler.

FIG. 7 is a circuit diagram of a conventional four-port power coupler 100. As used herein, the term "power coupler" refers to power splitters that divide an RF signal input thereto into two or more sub-components as well as power combiners that combine two or more RF signals input thereto into a single RF output signal. It will be appreciated that most power couplers are bi-directional devices that operate as power splitters for signals travelling in a first direction therethrough and as power combiners for signals travelling in the opposite direction. Accordingly, while references to input ports and output ports of power couplers (and devices including power couplers) will be made throughout this specification for convenience, it will be appreciated that whether or not any particular port acts as an "input" port or an "output" port will depend on the direction of travel of the RF signals input thereto.

As shown in FIG. 7, the conventional power coupler 100 includes an input port 110, first and second output ports 120-1, 120-2, and an isolation port 130. The power coupler 100 further includes coupling circuitry 140 that is coupled to the ports 110, 120-1, 120-2, 130. As is further shown in FIG. 7, typically the isolation port 130 is coupled to ground through a resistor 150. An RF signal incident at the input port 110 is split into two components that are delivered to the respective first and second output ports 120-1, 120-2. The split of the RF input signal may be equal or unequal depending upon the design of the power coupler 100. Typically, a four-port power coupler that equally splits an input RF signal is referred to as a hybrid coupler, while a power coupler that unequally splits an input RF signal is referred to as a directional coupler. Hybrid couplers typically are designed to have the first and second output ports output sub-components of the input RF signal that are either 90 degrees or 180 degrees out-of-phase with respect to each other. If the outputs are 90 degrees out-of-phase, the hybrid coupler may be referred to as a quadrature hybrid coupler or as a 90 degree hybrid coupler.

If the power coupler 100 is an "ideal" power coupler, an RF signal input to the input port 110 is equally split by the power coupler 100 and all of the power of the input RF signal flows out of the two output ports 120-1, 120-2, and no power flows to the isolation port 130. In the real world, such performance is not achievable, and some amount of power flows to the isolation port 130 (which reduces the amount of power that flows to the output ports 120-1, 120-2). The resistor 150 is provided to absorb the residual power that flows through the isolation port 130. If the resistor 150 is not provided, the first and second output ports 120-1, 120-2 will not be isolated from one another.

Figure 8:
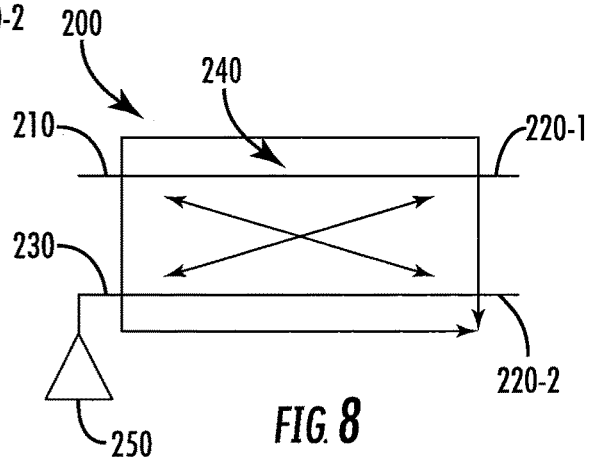
FIG. 8 is a circuit diagram of a four-port power coupler according to embodiments of the present invention.

FIG. 8 is a circuit diagram of a four-port power coupler 200 according to embodiments of the present invention. As shown in FIG. 8, the power coupler 200 includes an input port 210, first and second output ports 220-1, 220-2, an isolation port 230 and coupling circuitry 240. However, the resistive termination to ground 150 included in the power coupler 100 is replaced with an antenna absorber circuit 250. The power coupler 200 may operate in the exact same fashion as the power coupler 100 described above, except that the antenna absorber 250 acts to absorb the residual power that flows to the isolation port 230.

Figure 9:
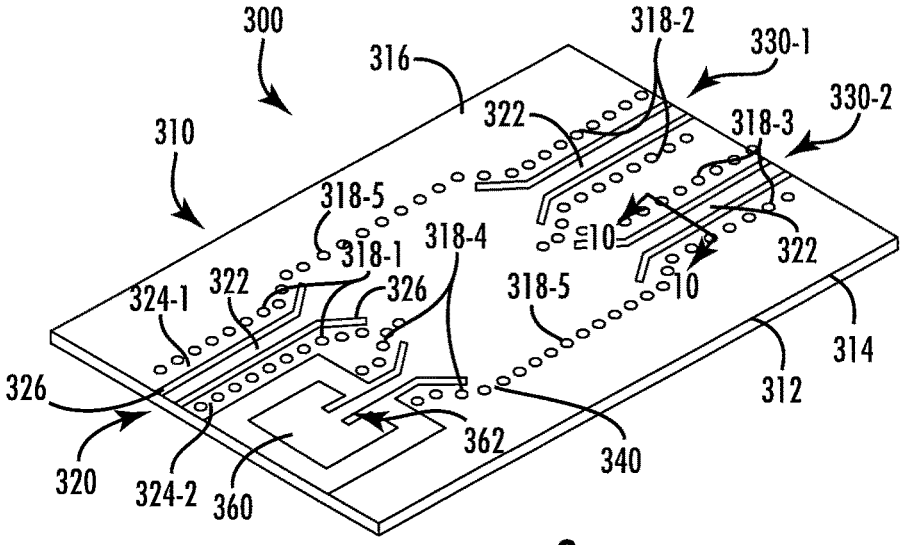
FIG. 9 is a schematic perspective view of a four-port power coupler according to embodiments of the present invention that uses an antenna power absorber.

FIG. 9 is a perspective view of a four-port power coupler 300 according to embodiments of the present invention that uses an antenna element power absorber.

As shown in FIG. 9, the power coupler 300 is implemented in a printed circuit board 310. The printed circuit board includes a dielectric substrate 312 that has first and second opposed major surfaces. A metal ground plane layer 314 is formed on the first major surface of the dielectric substrate 312. A metal pattern 316 is formed on the second major surface of the dielectric substrate 312. The metal pattern 316 may cover most of the second major surface of the dielectric substrate 312. A plurality of metal-plated or metal-filled vias 318-1 through 318-5 extend through the dielectric substrate 312 to electrically connect portions of the metal pattern 316 to the ground plane layer 314 and to confine RF signals within selected portions of the dielectric substrate 312.

The power coupler 300 is primarily implemented as a substrate integrated waveguide structure. As known in the art, a substrate integrated waveguide refers to a waveguide that is implemented in a dielectric substrate by metallizing opposed first and second surfaces of the dielectric substrate. Two rows of metal-filled vias are provided that extend through the dielectric substrate. The two rows of metal-filled vias form a metal waveguide structure that confines an input RF signal within the "sidewalls" defined by the two rows of metal-filled vias.

As shown in FIG. 9, the power coupler 300 includes an input port 320, first and second output ports 330-1, 330-2 and an isolation port 340. A co-planar waveguide is another type of waveguide structure that may be implemented in a printed circuit board. A co-planar waveguide structure includes a single conductive track that is formed on a first surface of a dielectric substrate of the printed circuit board. A pair of ground (return) conductors are formed on either side of the conductive track on the first surface of the dielectric substrate, and hence are co-planar with the conductive track. The return conductors are separated from the conductive track by respective small gaps which may have unvarying widths along the length of the co-planar waveguide transmission line. Metal-filled vias are provided that connect the return conductors to a ground plane that is provided on the second surface of the dielectric substrate.

Figure 10:
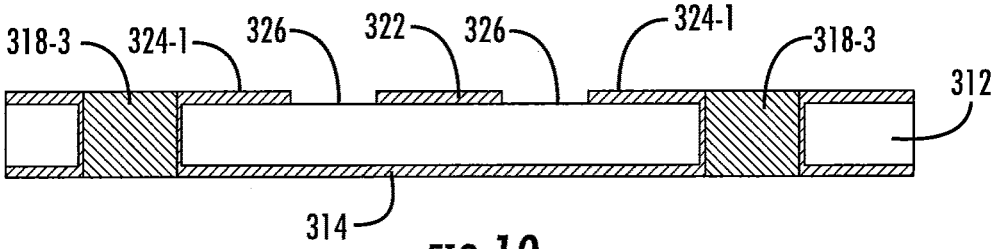
FIG. 10 is a cross-sectional view taken along line 10-10 of FIG. 9.

Referring again to FIG. 9, input port 320 includes a conductive track 322 that has return conductors 324-1, 324-2 disposed on either side thereof. Gaps 326 in the metal pattern 316 electrically separate the conductive track 322 from the respective return conductors 324-1, 324-2. A first group of metal-filled vias 318-1 connect the return conductors 324-1, 324-2 to the ground plane layer 314 on the opposite side of the dielectric substrate 312. RF energy input at input port 320 flows along the conductive track 322. FIG. 10 is a cross-sectional view taken along line 10-10 of FIG. 9. FIG. 10 more clearly illustrates the co-planar waveguide structure used to implement output port 330-2 (and is also representative of the co-planar waveguide structures used to implement ports 320, 330-1 and 340).

The first and second output ports 330-1, 330-2 are likewise implemented as co-planar waveguide transmission lines, with metal-filled vias 318-2 being part of the co-planar waveguide structure for output port 330-1 and metal-filled vias 318-3 being part of the co-planar waveguide structure for output port 330-2. A fourth group of metal-filled vias 318-4 form the isolation port 340. A fifth group of metal-filled vias 318-5 define a substrate integrated waveguide region of the power coupler 300.

As is further shown in FIG. 9, a patch radiating element 360 is implemented in the printed circuit board 310 at the output of the isolation port 340. The patch radiating element 360 comprises a generally rectangular metal patch radiator that is part of metal pattern 316 along with the portions of the dielectric substrate 312 and the ground plane layer 314 that are underneath the patch radiator. RF energy entering the isolation port 340 is fed to the patch radiating element 360 where it mostly may be dissipated and radiated. The patch radiating element 360 includes an inset feed 362 which may increase the bandwidth at which the patch radiating element 360 will operate as a power absorber.

While in the embodiment of FIG. 9 the power coupler 300 has co-planar waveguide input, output and isolation ports 320, 330-1, 330-2, 340, it will be appreciate that some or all of these ports may be implemented using other types of printed circuit board transmission lines such as, for example, microstrip transmission lines.

It should be noted that the power radiated by the patch radiating element 360 may be undesirable. For an RF signal travelling from input port 320 to output ports 330-1, 330-2, the power delivered to and radiated by the patch radiating element 360 may be very low (e.g., less than 10% $P_t$), and hence may be unlikely to raise issues. However, when an RF signal is input to ports 330-1 or 330-2, the power delivered to and radiated by the patch radiating element 360 may be much higher (e.g., close to 50% $P_t$). The boresight direction for the radiation will be perpendicular to the top surface of the printed circuit board 310, and hence the printed circuit board 310 may be oriented so that the power radiated by the patch radiating element 360 is transmitted in a direction where interference will be reduced. Additionally, in some embodiments, RF absorbing material may be positioned above the patch radiating element 360 to absorb much of the power radiated by the patch radiating element 360. RF absorbing material may be included as appropriate above and/or adjacent the antenna elements of any of the devices according to embodiments of the present invention described herein.

Figure 11:
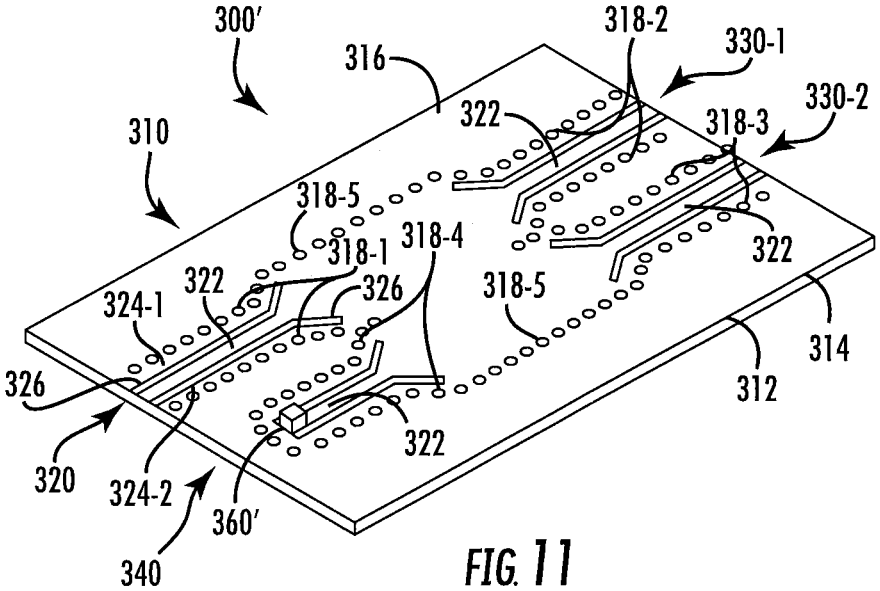
FIG. 11 (PRIOR ART)
FIG. 11 is a schematic perspective view of a power coupler that includes a conventional resistive termination to ground coupled to the isolation port thereof.

FIG. 11 is a schematic perspective view of a power coupler 300' that is identical to the power coupler 300, except that in power coupler 300' the patch radiating element 360 is omitted and a surface mount resistor 360' is coupled between the isolation port 340 and the ground layer 314.

Figure 12:
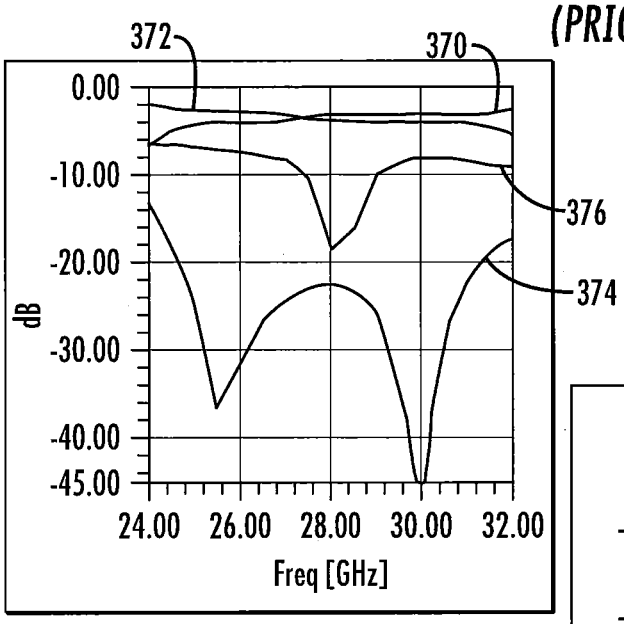
FIG. 12 is a graph illustrating the response of the power coupler of FIGS. 9-10 as a function of frequency.
Figure 13:
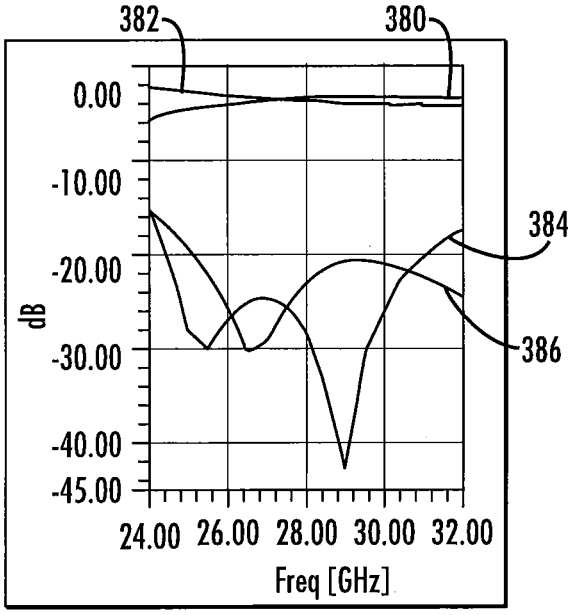
FIG. 13 (PRIOR ART)
FIG. 13 is a graph illustrating the response of the conventional power coupler of FIG. 11 as a function of frequency.

FIGS. 12 and 13 are graphs illustrating the response of the power couplers 300, 300', respectively, as a function of frequency. In FIG. 12, curve 370 represents the power coupled to the first output port 330-1 in response to an input signal having power $P_t$ applied at input port 320, and curve 372 represents the power coupled to the second output port 330-2 in response to an input signal having power $P_t$ applied at input port 320. Curve 374 represents the power reflected back to the input port 320 in response to an input signal having power $P_t$ applied at input port 320. It can be seen in FIG. 12 that curves 370 and 372 have values very close to −3 dB in the frequency range from 27-28.5 GHz. This shows that the input power $P_t$ is almost completely delivered to the first and second output ports 330-1, 330-2. The reflected power levels (curve 374) are low in this frequency range, ranging from about −22 to −26 dB. In other words, less than 1% of the power of the input signal is reflected backwards to the input port 320. This demonstrates that the patch radiating element 360 acts as an efficient power absorber in the frequency range of interest.

In FIG. 13, which corresponds to the power coupler 300' of FIG. 11, curve 380 represents the power coupled to the first output port 330-1 in response to an input signal having power $P_t$, curve 382 represents the power coupled to the second output port 330-2 in response to an input signal having power $P_t$, and curve 384 represents the power reflected back to the input port 320 in response to an input signal having power $P_t$. As can be seen by comparing FIGS. 12 and 13, the power couplers 300 and 300' provide similar performance in the frequency range of 24-32 GHz for all three of these parameters.

In FIGS. 12 and 13, curves 376 and 386 represent the power coupled to the second output port 330-2 in response to a signal input to the first output port 330-1. As shown in FIG. 12, the power coupler 300 having the patch radiating element 360 power absorber provides relatively good isolation in the frequency band of interest. However, the resistive absorber included in the power coupler 300' of FIG. 11 provides higher levels of isolation and provides good isolation over a substantially larger bandwidth. This is due to the narrow bandwidth of the patch radiating element 360. The bandwidth of the power coupler 300 may be increased by using printed circuit boards having thicker dielectric substrates.

Pursuant to further embodiments of the present invention, three-port power couplers are provided that use antenna elements as power absorbers. In an example embodiment, the three-way power divider may be similar to a Wilkinson power divider but may use an antenna element power absorber instead of a resistor.

Figure 14:
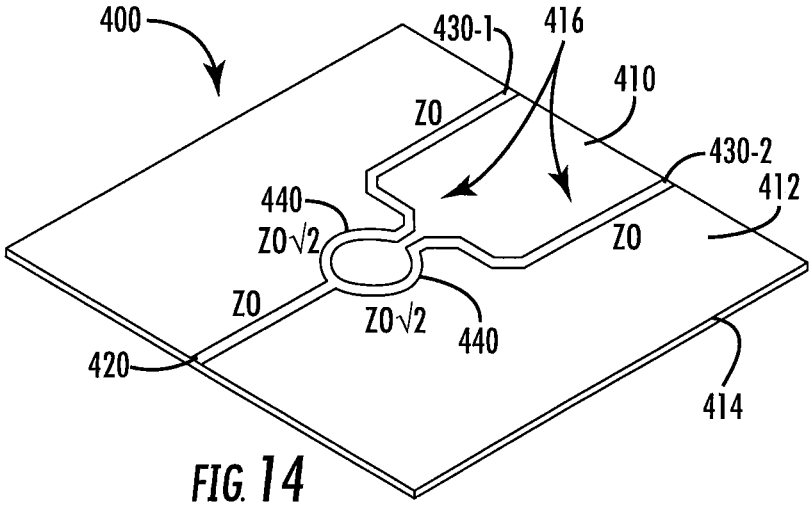
FIG. 14 (PRIOR ART)
FIG. 14 is a schematic perspective view of a conventional loss-less three-port power divider.

Referring first to FIG. 14, a loss-less power coupler 400 is pictured. The power coupler 400 is implemented on a printed circuit board 410 that includes a dielectric substrate 412, a conductive ground plane 414 on a lower surface of the dielectric substrate 412 and a conductive pattern 416 on an upper surface of the dielectric substrate 412. The power coupler 400 includes an input port 420, first and second output ports 430-1, 430-2, and coupling transmission lines 440. The coupling transmission lines 440 may have a narrower width so that the transmission lines connected to the input and output ports have a characteristic impedance of Z0, while the coupling transmission lines have a characteristic impedance of $Z0\sqrt{2}$. As such, each coupling transmission line 440 acts as a quarter wavelength transformer. The power coupler 400 of FIG. 14 may split the power of an RF signal input at input port 420, but does not provide isolation between the two output ports 430-1, 430-2.

Figure 15:
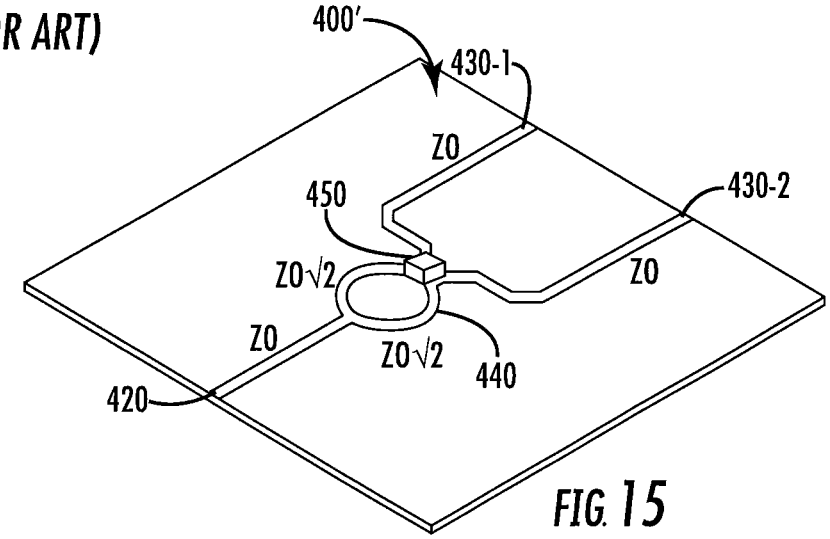
FIG. 15 (PRIOR ART)
FIG. 15 is a schematic perspective view of a conventional Wilkinson three-port power divider that includes a resistor between the output ports thereof.

Referring next to FIG. 15, a Wilkinson power coupler 400' is shown that is identical to the power coupler 400, but further includes a surface mount resistor 450 that is soldered between the two narrow coupling transmission lines 440. By selecting a proper resistance value for the resistor 450 a high degree of isolation may be maintained between the first and second output ports 430-1, 430-2.

Figure 16:
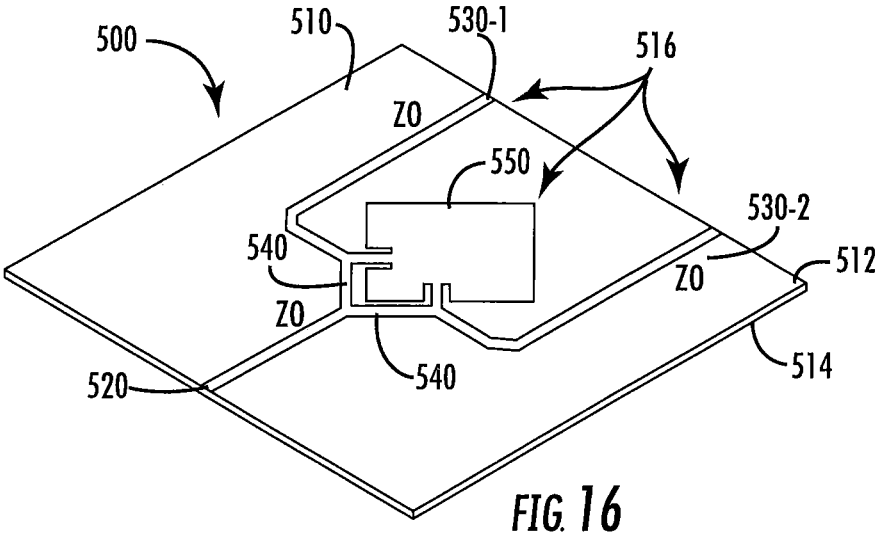
FIG. 16 is a schematic perspective view of a three-port power divider according to embodiments of the present invention.

Referring now to FIG. 16, a power coupler 500 according to embodiments of the present invention is depicted that replaces the resistor 450 of power coupler 400' with a patch radiating element 550. The power coupler 500 is implemented on a printed circuit board 510 that includes a dielectric substrate 512, a conductive ground layer 514 on a lower surface of the dielectric substrate 512 and a conductive pattern 516 on an upper surface of the dielectric substrate 512. The power coupler 500 includes an input port 520, first and second output ports 530-1, 530-2, and coupling transmission lines 540. The coupling transmission lines 540 may have a narrower width so that the transmission lines connected to the input and output ports 530-1, 530-2 have a characteristic impedance of Z0, while the coupling transmission lines 540 have a characteristic impedance of Z0√2. As such, each coupling transmission line 540 acts as a quarter wavelength transformer. As can be seen in FIG. 16, a patch radiating element 550 is directly connected to each transmission line 540. The patch radiating element 550 acts as a power absorber providing isolation between the first and second output ports 530-1, 530-2. The patch radiating element 550 is part of the conductive pattern 516 and hence can be implemented in the same step as the input port 520, the output ports 530-1, 530-2 and the coupling transmission lines 540 by simply changing the shape of the etch mask used to etch the conductive pattern 516 from a metal layer deposited on the upper surface of the dielectric substrate 512.

Figure 17:
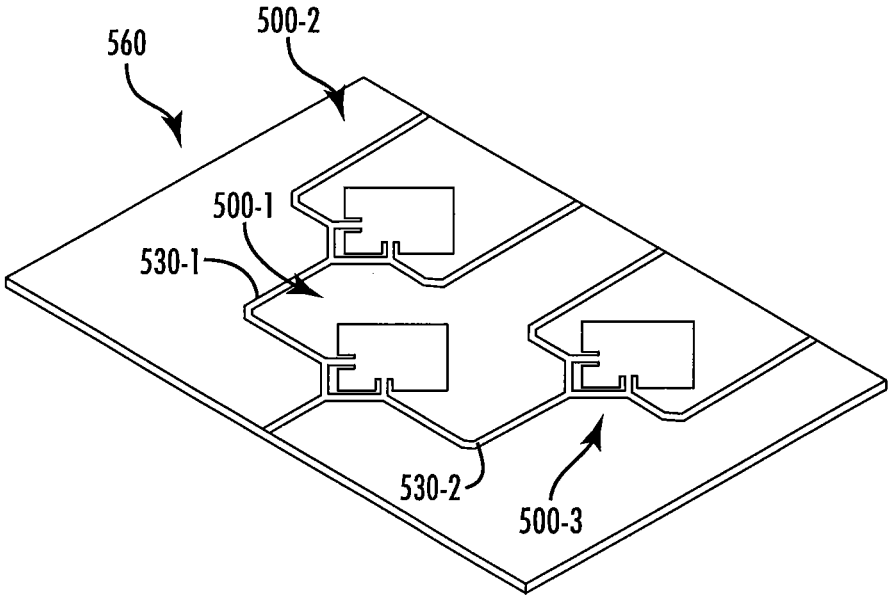
FIG. 17 is a schematic perspective view of a 1×4 power coupler that is formed using three of the power couplers of FIG. 16.

The 1×2 power couplers according to embodiments of the present invention that are discussed above may be used to form power couplers that further split an input signal. For example, FIG. 17 is a schematic perspective view of a 1×4 power coupler 560 that is formed using three of the power couplers 500 according to embodiments of the present invention of FIG. 16. As shown in FIG. 17, the first output port 530-1 of a first power coupler 500-1 is connected to the input port of a second power coupler 500-2, and the second output port 530-2 of the first power coupler 500-1 is connected to the input port of a third power coupler 500-3. The same technique may be used to form power couplers that further sub-divide an RF signal. For example, two of the 1×4 power couplers 560 could be fed by the outputs of another 1×2 power coupler 500 to form a 1×8 power coupler.

The power couplers according to embodiments of the present invention that use antenna elements as power absorbers may be easier and cheaper to fabricate as compared to power couplers that use conventional resistors. The power couplers according to embodiments of the present invention may also eliminate the need for specialized soldering techniques that may be necessary given the small size of some surface mount resistors at millimeter wave frequencies. Moreover, when the length and/or height of the resistor is too close to a quarter wavelength of the operating frequency it may not be possible to use surface mount resistors as they may not act like resistors due to their length and/or height in comparison with a quarter wavelength of the operating frequency. At 30 GHz, a quarter wavelength is about 1.5 mm for a signal travelling in a typical printed circuit board dielectric substrate. A resistor that is 0.5 mm long thus is relatively close in length to a quarter wavelength, and may become too close at higher millimeter wave frequencies. When a lumped circuit element like a resistor becomes too close in length and/or height to a quarter wavelength of the RF signal, parasitic features become significant and the lumped circuit element also starts to radiate. The parasitic features and/or the radiation may be undesirable. The power couplers according to embodiments of the present invention provide a viable solution at such frequencies.

As described above, pursuant to some embodiments of the present invention, printed circuit board based power couplers are provided that use patch radiating elements as power absorbers. It will be appreciated in light of the present disclosure that numerous other applications exist for the present invention, including implementations that are made in waveguides, stripline or other mediums, implementations that use other forms of antenna elements such as horn radiating elements or slot radiating elements, and implementations where the antenna element is used in place of a series, as opposed to a shunt, resistor. The techniques according to embodiments of the present invention may also be used in other circuit elements such as, for example, balanced filters or balanced amplifiers. Example embodiments of these further aspects of the present invention will now be described with reference to FIGS. 18-26.

Figure 18:
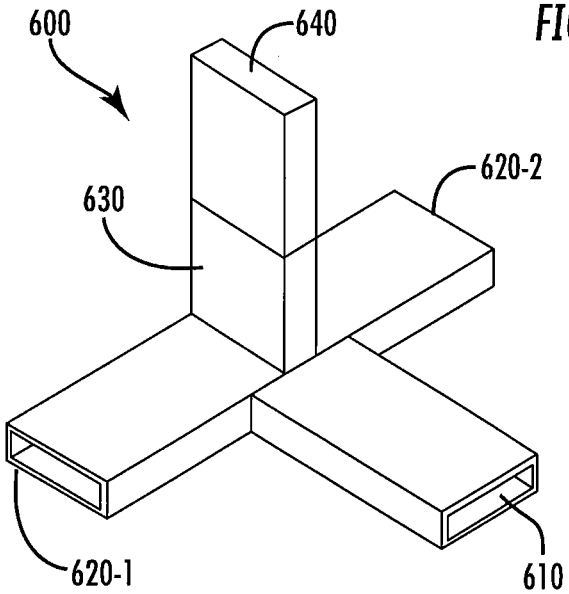
FIG. 18 (PRIOR ART)
FIG. 18 is a schematic perspective view of a conventional waveguide power coupler.

FIG. 18 is a schematic diagram of a conventional waveguide power coupler 600. As shown in FIG. 18, the power coupler 600 has an input waveguide 610, first and second output waveguides 620-1, 620-2 and an isolation port waveguide 630. The input waveguide 610 and the first and second output waveguides 620-1, 620-2 are positioned in a T-shaped arrangement, and the isolation port waveguide 630 is positioned at the intersection of the waveguides 610, 620-1, 620-2 and extends perpendicularly thereto. A resistive termination 640 is attached to the isolation port 630. The waveguide 600 is often referred to as a waveguide Magic T coupler.

Figure 19:
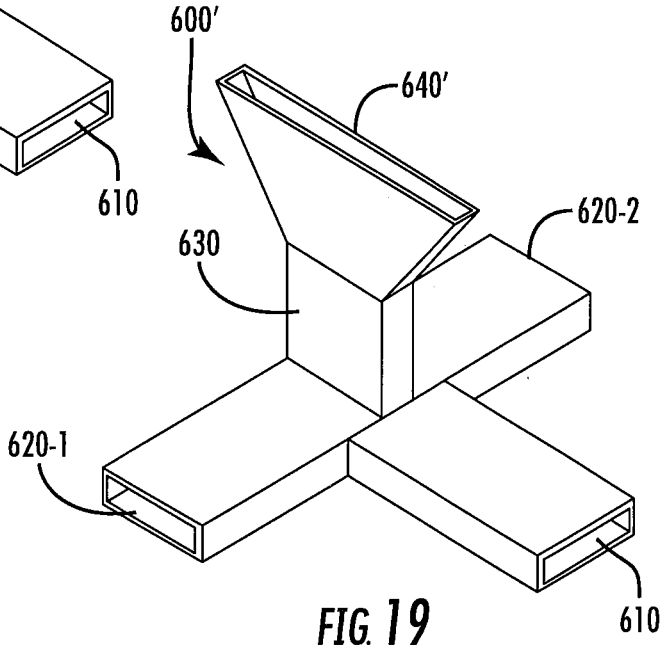
FIG. 19 is a schematic perspective view of a waveguide power coupler according to embodiments of the present invention.

FIG. 19 is a schematic diagram of a waveguide Magic T coupler 600' according to embodiments of the present invention. As can be seen, the Magic T coupler 600' is identical to the Magic T coupler 600, except that the resistive termination 640 included in the Magic T coupler 600 is replaced with a horn antenna element 640' (or any other appropriate antenna element) in the Magic T coupler 600' of FIG. 19. The horn antenna element 640' will act as a power absorber in a frequency band of interest in the same manner that the patch radiating elements discussed above act as power absorbers.

Figure 20:
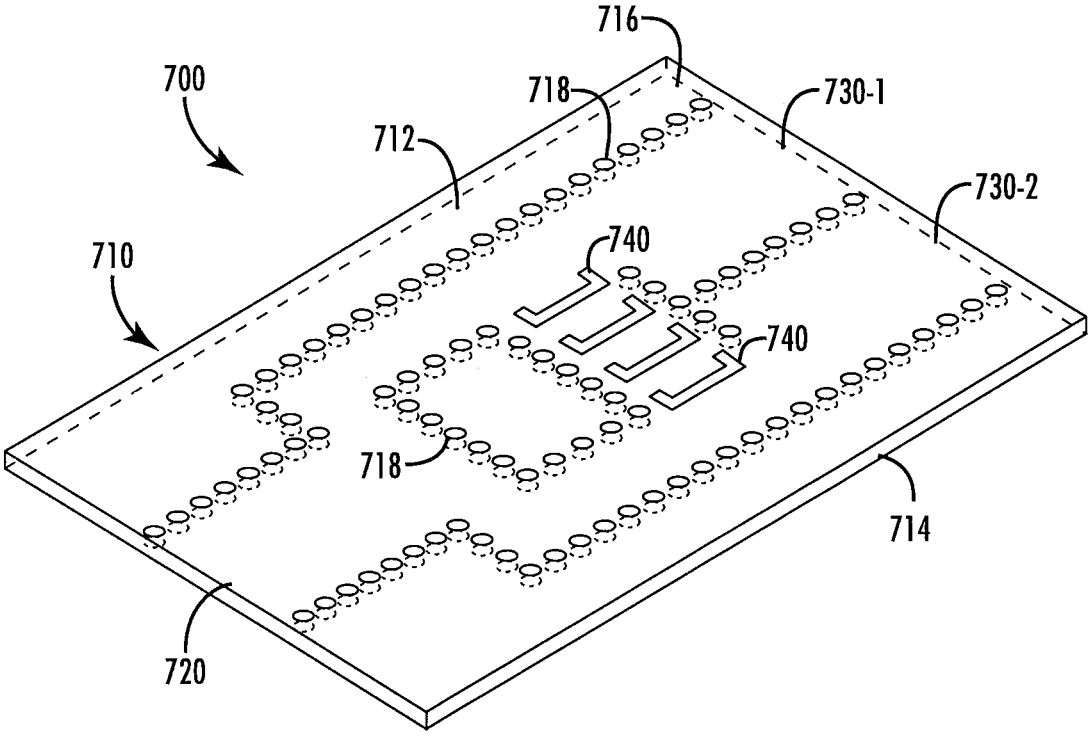
FIG. 20 is a schematic perspective view of a power coupler according to embodiments of the present invention that is implemented as a substrate integrated waveguide power coupler.

FIG. 20 is a schematic perspective view of a power coupler 700 implemented in a substrate integrated waveguide that uses a series of slot radiating elements as a power absorber. As shown in FIG. 20, the power coupler 700 is implemented in a printed circuit board 710 that includes a dielectric substrate 712 that has a metal ground plane layer 714 formed on its lower surface and a metal pattern 716 formed on its upper surface. A plurality of metal-plated or metal-filled vias 718 extend through the dielectric substrate 712 to electrically connect portions of the metal pattern 716 to the ground plane layer 714 and to confine RF signals within selected portions of the dielectric substrate 712.

The power coupler 700 has an input port 720 and first and second output ports 730-1, 730-2 that are defined in the printed circuit board 710 by the metal-filled vias 718. The ground plane layer 714, metal pattern 716 and metal-plated vias 718 form a substrate integrated waveguide adjacent the input port 720 that splits into a pair of substrate integrated waveguides that connect to the respective output ports 730-1, 730-2. As further shown in FIG. 20, a series of slot antennas 740 are formed in the printed circuit board 710 by removing portions of the metal pattern 716 that are above a passageway connecting the first and second output ports 730-1, 730-2. The slot antennas 740 may be sized to radiate energy in the frequency band of the power coupler 700. FIG. 20 thus illustrates how slot antennas may be used instead of patch radiating elements in some embodiments.

Figure 21A:
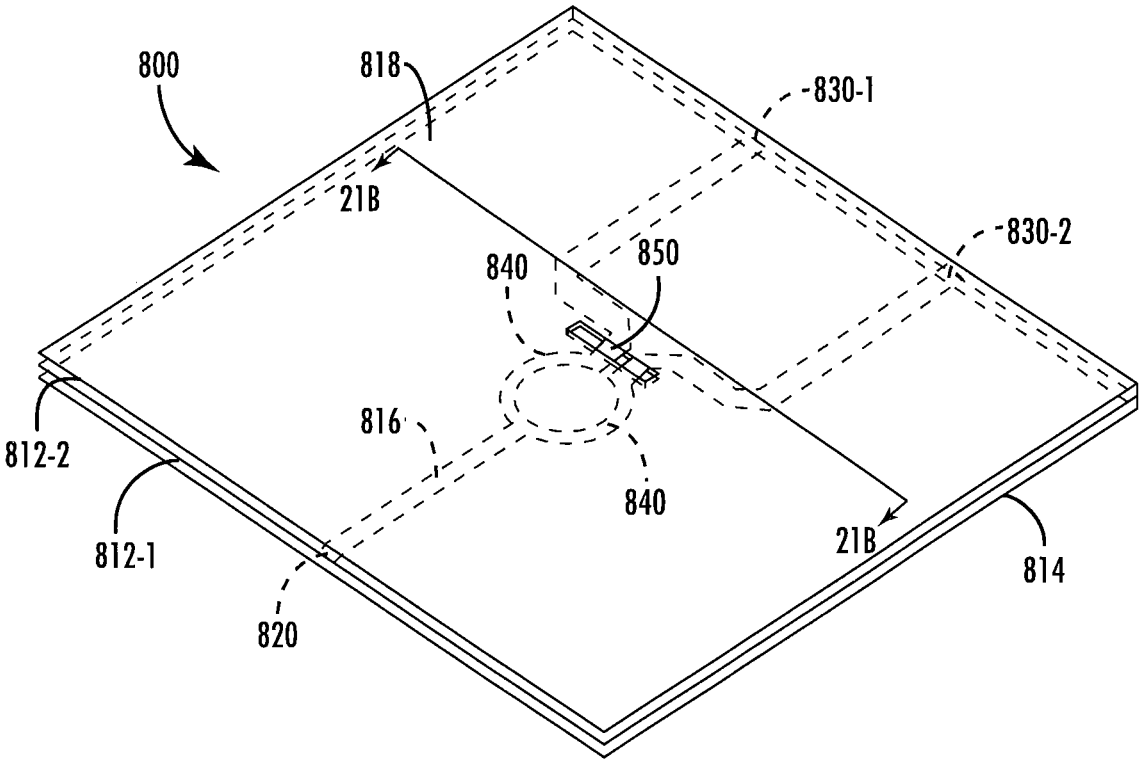
FIG. 21A is a schematic perspective view of the stripline power coupler according to further embodiments of the present invention.
Figure 21B:
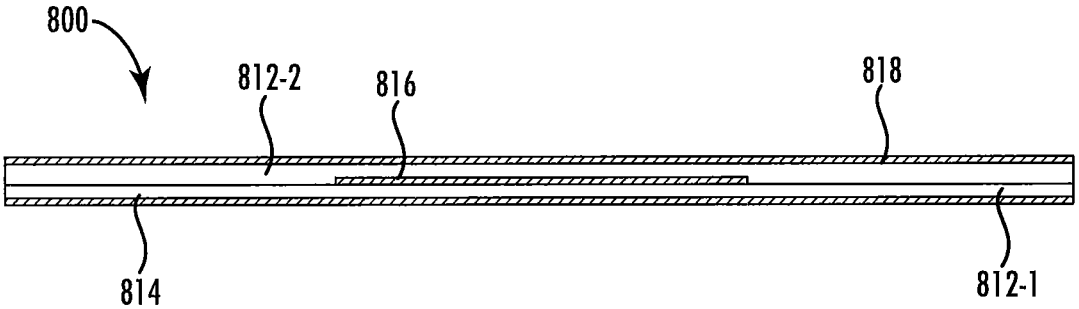
FIG. 21B is a cross-sectional view taken along line 21B-21B of FIG. 21A.

FIGS. 21A and 21B illustrate a power coupler 800 according to embodiments of the present invention that is implemented in stripline. In particular, FIG. 21A is a schematic perspective view of the stripline power coupler 800, while FIG. 21B is a cross-section taken along line 21B-21B of FIG. 21A.

The power coupler 800 is another three-port power coupler design. The power coupler 800 is implemented in a stripline printed circuit board that includes first and second stacked dielectric substrates 812-1, 812-2 and first through third metal patterns 814, 816, 818. The first metal pattern 814 is formed on the lower surface of the first dielectric substrate 812-1 and serves as a ground plane layer, and the third metal pattern 818 is formed on the upper surface of the second dielectric substrate 812-2 and also serves as a ground plane layer. A three-port power coupler is implemented in the second metal pattern 816, which is formed between the first and second dielectric substrates 812-1, 812-2. The three-port power coupler includes an input port 820, first and second output ports 830-1, 830-2, and coupling transmission lines 840, which can be identical to the corresponding elements in the power coupler 500 of FIG. 16. A slot antenna element 850 is formed in the third metal pattern 818 above the location where the coupling transmission lines 840 come together to feed the respective output ports 830-1, 830-2. The slot antenna element 850 acts as a power absorber providing isolation between the first and second output ports 830-1, 830-2.

Figure 22:
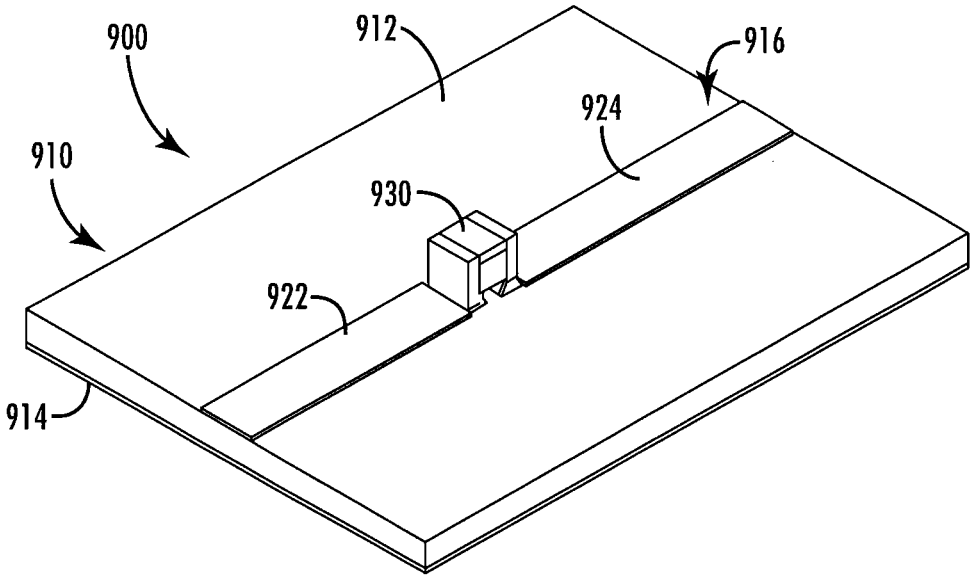
FIG. 22 (PRIOR ART)
FIG. 22 is a schematic perspective view of a conventional printed circuit board that includes a pair of transmission line segments that are connected by a series surface mount resistor.
Figure 23:
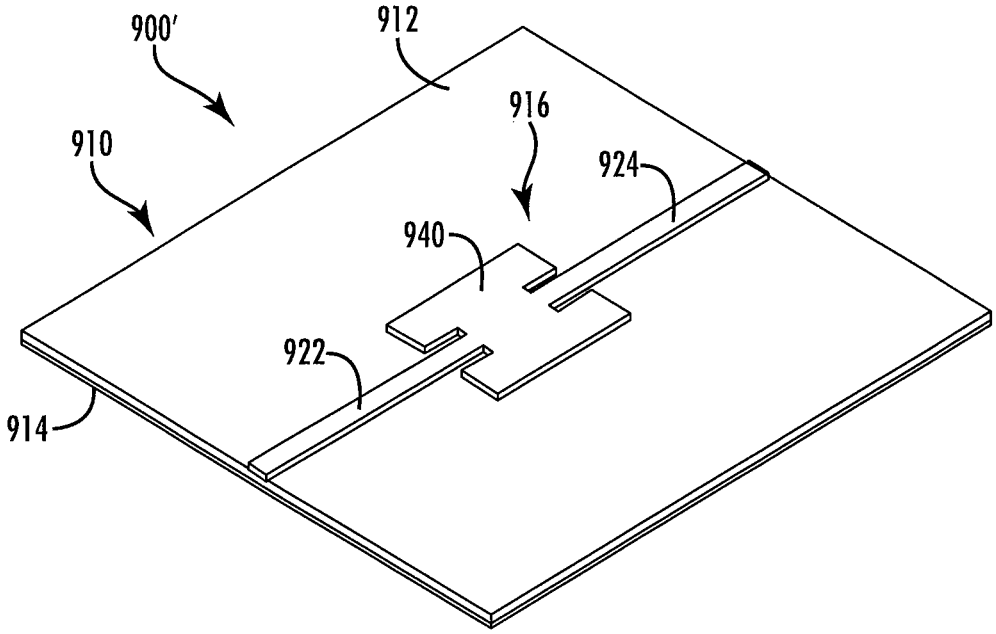
FIG. 23 is a schematic perspective diagram of a printed circuit board according to embodiments of the present invention.

FIG. 22 is a schematic perspective diagram of a printed circuit board 900 having a dielectric substrate 912, ground plane layer 914 and metal pattern 916. The metal pattern 916 comprises a transmission line 916. A series surface mount resistor 930 is mounted on the printed circuit board 900 and divides the transmission line 916 into first and second segments 922, 924. FIG. 23 is a schematic perspective diagram of a printed circuit board 900' according to embodiments of the present invention in which the series surface mount resistor 930 of FIG. 22 is replaced with an antenna power absorber 940. As can be seen, the printed circuit board 900' may be identical to the printed circuit board 900 except that a patch radiating element 940 is used in place of the series resistor 930. Both transmission line segments 922, 924 may connect to the patch radiating element 940. In the depicted embodiment, the transmission line segments 922, 924 each have inset feeds so that they connect to respective interior portions of the patch radiating element 940. This may increase the bandwidth at which the patch radiating element 940 may act as a good power absorber. The dimensions of the patch radiating element 940 may be selected so that the patch radiating element radiates RF energy in the operating bandwidth of a device that includes the printed circuit board 900'.

Figure 24:
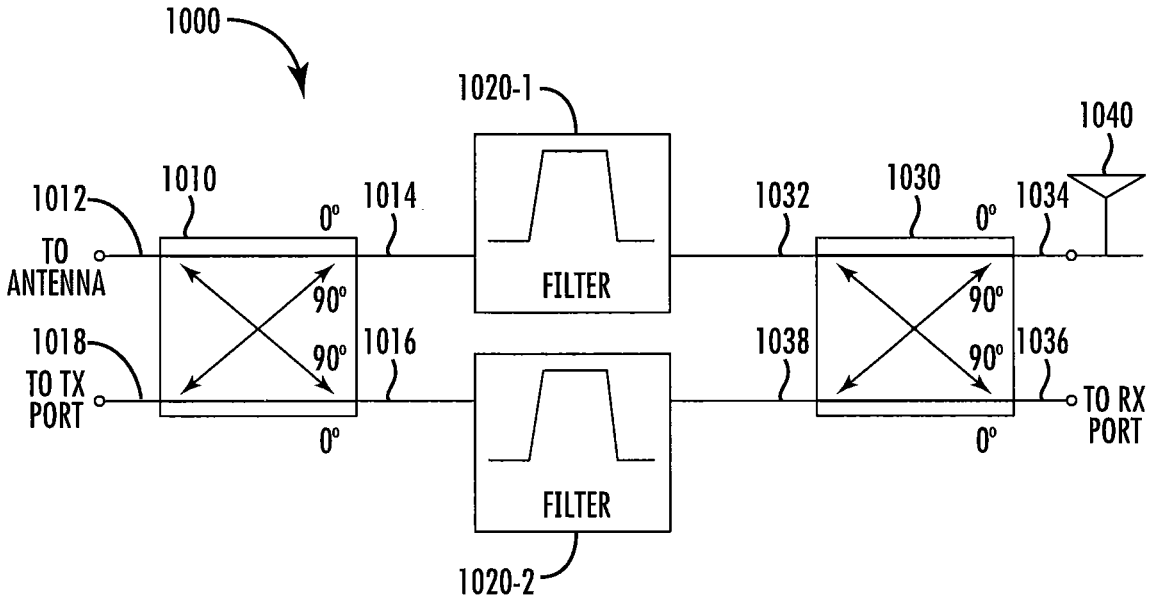
FIG. 24 is a schematic block diagram of a balanced filter according to further embodiments of the present invention.

FIG. 24 is a schematic block diagram of a balanced filter 1000 according to further embodiments of the present invention. In the example shown in FIG. 24 the balanced filter is a balanced diplexer 1000. Other balanced filters may be formed using the antenna element power absorbers according to embodiments of the present invention such as, for example, balanced multiplexers. The balanced filters according to embodiments of the present invention may have a conventional design except that they may use an antenna element power absorber according to embodiments of the present invention in place of a conventional resistive termination.

Referring to FIG. 24, the balanced diplexer 1000 that is illustrated is shown being used to connect a transmit port and a receive port of a radio to an antenna such as, for example, a base station antenna. As shown in FIG. 24 the balanced diplexer 1000 includes a first power coupler 1010, first and second filters 1020-1, 1020-2, a second power coupler 1030 and a power absorbing antenna element 1040. The first power coupler 1010 is a four-port power coupler that includes a first port 1012 that is coupled to the antenna, a second port 1014 that is coupled to a first port of the first filter 1020-1, a third port 1016 that is coupled to a first port of the second filter 1020-2, and a fourth port that is coupled to the transmit port of the radio. The first power coupler 1010 may comprise a 90 degree hybrid coupler having equal power division. As known to those of skill in the art, a 90 degree hybrid coupler injects a 90 degree phase change on "cross-coupled signals" (i.e., signals that travel between ports connected by a diagonal line in FIG. 24) as compared to "pass-through" signals (i.e., signals that travel between ports connected by a straight line in FIG. 24). Thus, for example, a signal input at port 1012 is split in half and output at ports 1014, 1016, with the signal output at port 1016 including an extra 90 degrees of phase shift.

The second power coupler 1030 may be identical to the first power coupler 1010, having first through fourth ports 1032, 1034, 1036, 1038. The first port 1032 is coupled to the second port of the first filter 1020-1, the second port 1034 is coupled to the power absorbing antenna element 1040, the third port 1036 is coupled to the receive port of the radio, and the fourth port 1038 is coupled to the second port of the second filter 1020-2. The power absorber antenna element 1040 may be used in place of a resistive termination to ground that is included in conventional balanced diplexers. The first and second filters 1020-1, 1020-2 may be identical filters and may comprise, for example, bandpass filters having a passband that extends between a first frequency f1 and a second frequency f2. In an example embodiment, the receive band of the radio may be f2−f1. It will also be appreciated that in other embodiment identical bandstop filters could be used in place of the identical bandpass filters with other appropriate reconfiguration of the balanced diplexer 1000.

When a signal is received at the antenna, it is input to port 1012 of the first power coupler 1010. The received signal is split in half by the first power coupler 1010, and the two sub-components thereof are fed to the respective first and second filters 1020-1, 1020-2, with the two-sub-components being 90 degrees out-of-phase with each other. After the sub-components are filtered, they are input to ports 1032 and 1038, respectively, of the second power coupler 1030. Each sub-component input to port 1032 is again split in half, and a 90 degree phase shift is applied to the cross-coupled sub-component, and each sub-component input to port 1038 is likewise split in half, and a 90 degree phase shift is applied to the cross-coupled sub-component. Thus, a pair of signals are received at each of ports 1034 and 1036. The two signals received at port 1036 constructively combine, since each of these signals will have been cross-coupled once. The constructively combined signal then is passed to the receive port of the radio. The two signals received at port 1034 are 180 degrees out of phase with each other, since one of the two signals was a pass through signal through each power coupler 1010, 1030 and the other signal was a cross-coupled signal through each power coupler 1010, 1030. These two signal therefore cancel each other out at port 1034. Since the cancellation typically will not be perfect, the antenna element power absorber 1040 acts to absorb the vast bulk of any residual power present at port 1034.

When a signal to be transmitted is passed from the transmit port of the radio to port 1018 of the first power coupler 1010, the signal is split in half by the first power coupler 1010, and the two sub-components thereof are fed to the respective first and second filters 1020-1, 1020-2, with the sub-components passed to port 1014 including an additional 90 degree phase shift. Since the transmit signal is not within the receive band f2−f1, the sub-components of the signal passed to ports 1014 and 1016 are rejected (reflected) by the band pass filters 1020-1, 1020-2. Each reflected signal is split in half and passed back to ports 1012, 1018 of power coupler 1010, with the cross-coupled reflected signals receiving an additional 90 degree phase shift. The two reflected signals received at port 1012 will each have been cross-coupled once, and hence will constructively combine at port 1012 and be passed to the antenna for transmission. The two reflected signals received at port 1018 will include one signal that traversed power coupler 1010 twice as a pass-through signal and one signal that passed through power-coupler 1010 twice as a cross-coupled signal (and hence underwent an additional 180 degree phase shift). These two signals thus cancel at port 1018.

Figure 25:
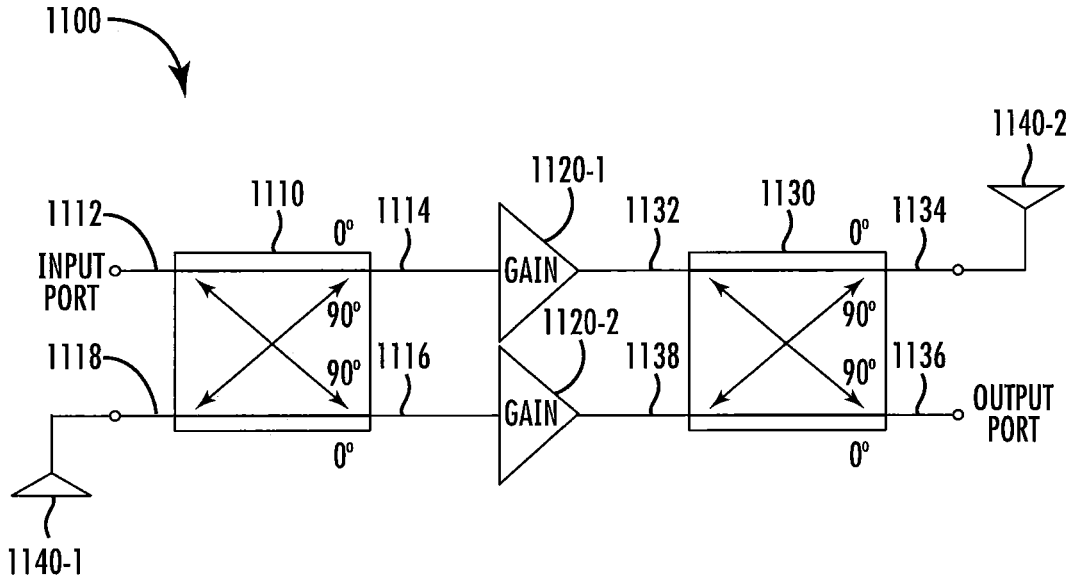
FIG. 25 is a schematic block diagram of a balanced amplifier according to further embodiments of the present invention.

FIG. 25 is a schematic block diagram of a balanced amplifier 1100 according to further embodiments of the present invention. As shown in FIG. 25 the balanced amplifier 1100 includes a first power coupler 1110, first and second amplifiers 1120-1, 1120-2, a second power coupler 1130 and first and second power absorbing antenna elements 1140-1, 1140-2. The first power coupler 1110 is a four-port power coupler that includes a first port 1112 that acts as the input port for the balanced amplifier 1100, a second port 1114 that is coupled to a first port of the first amplifier 1120-1, a third port 1116 that is coupled to a first port of the second amplifier 1120-2, and a fourth port 1118 that is coupled to the a first power absorbing antenna element 1140-1. The first power coupler 1110 may comprise a 90 degree hybrid coupler having equal power division.

The second power coupler 1130 may be identical to the first power coupler 1110, having first through fourth ports 1132, 1134, 1136, 1138. The first port 1132 is coupled to the second port of the first amplifier 1120-1, the second port 1134 is coupled to a second power absorbing antenna element 1140-2, the third port 1136 acts as the output port for the balanced amplifier 1100, and the fourth port 1138 is coupled to the second port of the second amplifier 1120-2. The power absorber antenna elements 1140-1, 1140-2 may be used in place of resistive terminations to ground that are included in conventional balanced amplifier. The first and second amplifiers 1120-1, 1120-2 may be identical amplifiers.

When a signal is input at the input port 1112, it is split in half by the first power coupler 1110, and the two sub-components thereof are fed to the respective first and second amplifiers 1120-1, 1120-2, with the cross-coupled component that is passed to the second amplifier 1120-2 including an additional 90 degrees of phase shift. If the impedance match between the amplifiers 1120-1, 1120-2 and the input is not perfect, each amplifier 1120-1, 1120-2 will generate a reflected signal that is split in half by power coupler 1110 and passed backwards to ports 1112, 1118. The reflected signals passed to port 1112 will include (1) a first reflected signal that passed from port 1112 to port 1114 and then back from port 1114 to port 1112 and (2) a second reflected signal that passed from port 1112 to port 1116 and then back from port 1116 to port 1112. Thus, the first reflected signal received at port 1112 passed through power coupler 1110 twice as a pass-through signal, while the second reflected signal received at port 1112 passed through power coupler 1110 twice as a cross-coupled signal (and hence experienced a 180 degree phase shift relative to the first reflected signal). Thus, the two reflected signals received at port 1112 cancel each other out. The same is true with respect to the two reflected signals received at port 1118. This phase cancellation may provide a nearly perfect impedance match at the input to the balanced amplifier 1100.

The sub-components of the input signal that pass to the first and second amplifiers 1120-1, 1120-2 are amplified and passed to ports 1132, 1138 of the second power coupler 1130, respectively. Each sub-component input to port 1132 is again split in half, and a 90 degree phase shift is applied to the cross-coupled sub-component, and each sub-component input to port 1138 is likewise split in half, and a 90 degree phase shift is applied to the cross-coupled sub-component. Thus, a pair of signals are received at each of ports 1134 and 1136. The two signals received at port 1136 constructively combine, since each of these signals will have cross-coupled once. The constructively combined signal is output from the balanced amplifier 1100. The two signals received at port 1134 are 180 degrees out of phase with each other, since one of the two signals was a pass through signal through each power coupler 1110, 1130 and the other signal was a cross-coupled signal through each power coupler 1110, 1130. These two signal therefore cancel each other out at port 1134. Since the cancellation typically will not be perfect, the antenna element power absorber 1140-2 acts to absorb the vast bulk of any residual power present at port 1134.

In some embodiments, the power couplers according to embodiments of the present invention may be used in the feed network of a millimeter wave phased array antenna. A phased array antenna refers to an antenna that includes a plurality of radiating elements that is used to transmit and receive RF signals. An RF signal that is to be transmitted through a phased array antenna may be divided into a plurality of sub-components, and each sub-component may be fed to a respective one of the radiating elements, or to a group of the radiating elements that is typically referred to as a sub-array. The magnitudes and/or phases of the sub-components of the RF signal may be adjusted so that the sub-components will coherently combine in a desired direction. The magnitudes and phases may be changed to electronically steer the antenna beam in different directions. The larger the aperture of the antenna array the narrower the antenna beam that may be formed by the phased array antenna. A small aperture antenna array with many antenna elements may have much lower gain than a larger aperture antenna array with fewer antenna elements.

Figure 26:
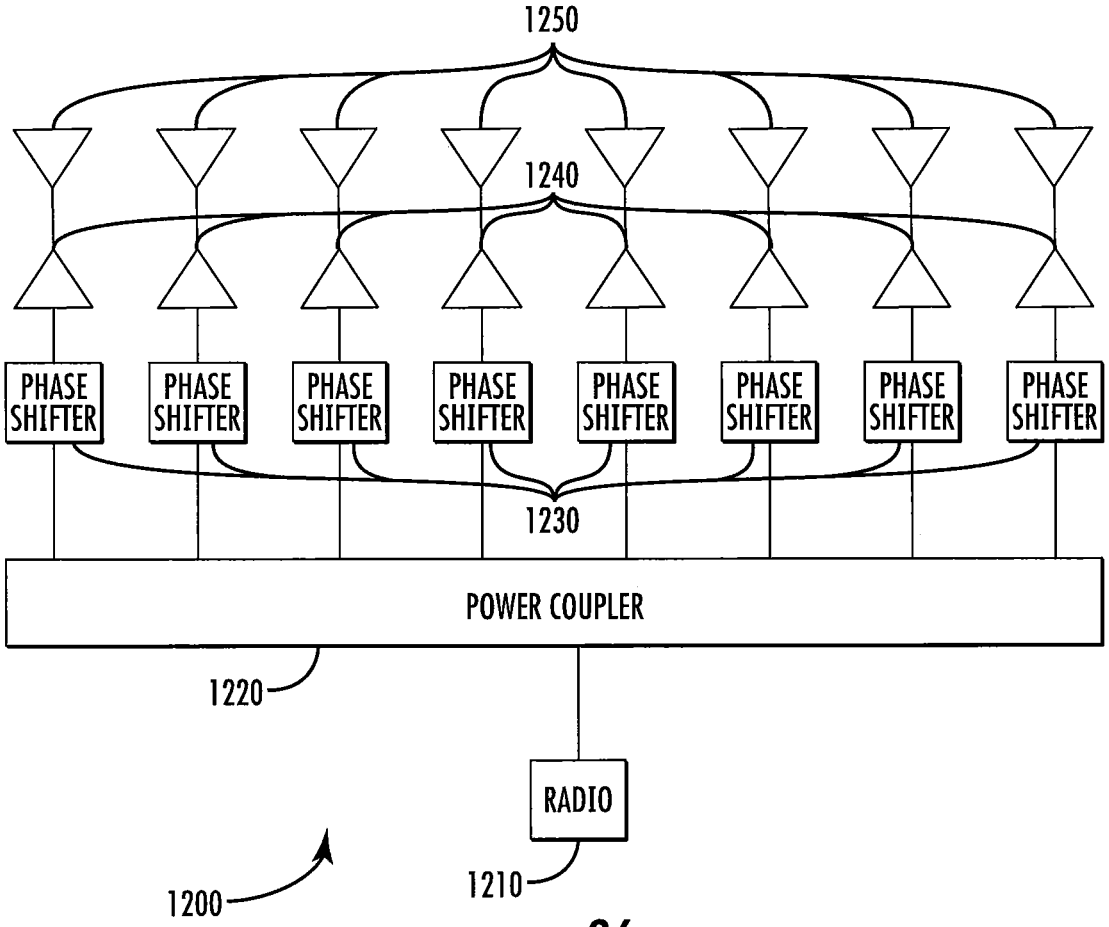
FIG. 26 is a block diagram of a phased array antenna according to embodiments of the present invention.

FIG. 26 is a block diagram of a phased array antenna 1200 according to embodiments of the present invention that includes power couplers that have antenna element power absorbers. As shown in FIG. 26, the phased array antenna 1200 includes (or is coupled to) an RF source 1210 such as a radio. RF signals output by the radio 1210 are input to a power coupler 1220. The power coupler 1220 may comprise any of the power couplers according to embodiments of the present invention. In FIG. 26, the power coupler 1220 is a 1×8 power coupler. As discussed above with reference to FIG. 17, such a 1×8 power coupler 1220 can be formed by cascading a plurality of 1×2 power couplers.

The 1×8 power coupler 1220 divides the RF signal received from the radio 1210 into eight sub-components. The sub-components may or may not have the same magnitude, since the 1×2 power couplers that may be used to form the 1×8 power coupler 1220 may be configured for unequal power division, if desired. The eight sub-components of the RF signal are passed from the 1×8 power coupler 1220 to eight phase shifters 1230. The phase shifters 1230 may apply different phase shifts to the eight sub-components of the RF signal that are designed to form an antenna beam that will coherently combine in a desired direction, as discussed above. The phase shifted sub-components of the RF signal are input to respective amplifiers 1240 which increase the power levels of the RF sub-components to levels appropriate for transmission. Each amplified sub-component then is transmitted through a respective antenna element 1250 such as, for example, a dipole or patch radiating element.

As noted above, the bandwidth of a patch radiating element may be relatively narrow. While using an inset feed on the patch radiating element can increase the bandwidth, this approach can only provide limited improvement. In some cases, wide bandwidth power absorbers may be desired. In such cases, antenna elements having a wider bandwidth may be used.

Figure 27:
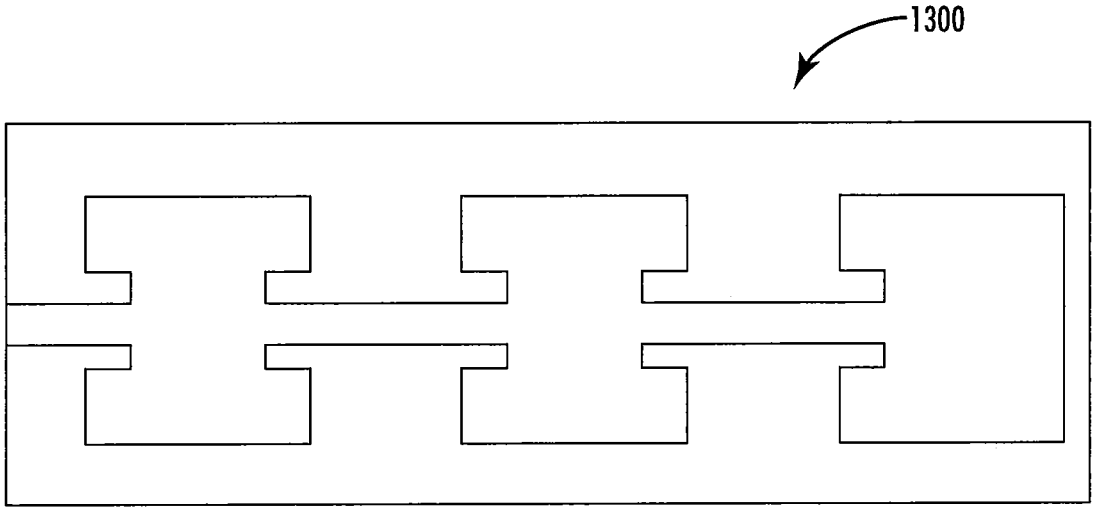
FIG. 27 is a schematic plan view of a printed circuit board based log periodic antenna that may be used as a power absorber in any of the power couplers according to embodiments of the present invention.

For example, traveling wave or log periodic antenna elements may be formed in a printed circuit board as disclosed, for example, in Yanfeng Geng, *Single microstrip layer holds UWB log-periodic antenna*, http://www.mwrf-.com/passive-components/single-microstrip-layer-holds-uwb-log-periodic-antenna. FIG. 27 is a schematic plan view of such a printed circuit board based log periodic antenna 1300 that could be used in place of any of the antenna elements disclosed herein such as the patch radiating element 360 of FIG. 9.

As discussed above, at millimeter wave frequencies, commercially available resistors may be too close in size to a quarter wavelength of the transmission frequency which may result in the resistors having both a resistive as well as a significant reactive component, which can negatively impact system performance. Additionally, special techniques may be required to solder such surface mount resistors to a mounting substrate that includes the antenna elements, to reduce the impact that the soldered connection may have on performance. By using antenna elements in place of the resistors in the 1×8 power coupler 1220 the design and fabrication of the power coupler may be simplified.

The present invention has been described above with reference to the accompanying drawings. The invention is not limited to the illustrated embodiments; rather, these embodiments are intended to fully and completely disclose the invention to those skilled in this art. In the drawings, like numbers refer to like elements throughout. Thicknesses and dimensions of some elements may not be to scale.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity. As used herein the expression "and/or" includes any and all combinations of one or more of the associated listed items.

Aspects and features of any of the above embodiments can be included in any of the other embodiments to provide additional embodiments.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention.

What is claimed is:

1. A power coupler, comprising:

an input port;

a first output port;

a second output port;

an isolation port;

an antenna element that is electrically coupled to the isolation port;

wherein the power coupler is configured to split a radio frequency ("RF") signal incident at the input port and/or to combine radio signals incident at the respective first and second output ports.

2. The power coupler of claim 1, wherein the antenna element comprises a patch radiating element.

3. The power coupler of claim 1, in combination with first and second filters that are coupled to the respective first and second output ports and a second power coupler that is coupled to the first and second filters opposite the power coupler, the combination of the power coupler, the second power coupler and the first and second filters comprising a balanced filter.

4. The power coupler of claim 1, in combination with first and second amplifiers that are coupled to the respective first and second output ports and a second power coupler that is coupled to the first and second amplifiers opposite the power coupler, the combination of the power coupler, the second power coupler and the first and second amplifiers comprising a balanced amplifier.

5. The power coupler of claim 1, wherein the power coupler is implemented in a printed circuit board that includes a dielectric substrate, a conductive ground plane on a first surface of the dielectric substrate and a conductive pattern on a second surface of the dielectric substrate that is opposite the first surface.

6. The power coupler of claim 5, wherein at least a portion of the power coupler is implemented as a substrate integrated waveguide power coupler that includes an array of plated through holes that connect the conductive ground plane to the conductive pattern.

7. The power coupler of claim 5, wherein at least a portion of the power coupler is implemented as a coplanar waveguide that includes an array of plated vias that connect the conductive ground plane to first and second ground portions of the conductive pattern, the conductive pattern further including a conductive track that is separated from the first and second ground portions by respective first and second gaps.

8. The power coupler of claim 5, wherein the antenna element is a patch radiating element that includes a patch radiator that is part of the conductive pattern, and wherein the patch radiator has an inset feed.

9. The power coupler of claim 1, wherein the antenna element is configured to function as a power absorber for RF signals in an operating frequency band of the power coupler.

10. A printed circuit board structure, comprising:

a dielectric substrate having a first surface and a second surface opposite the first surface;

a conductive ground plane on the first surface of the dielectric substrate; and a conductive pattern on the second surface of the dielectric substrate, the conductive pattern including an antenna element, wherein a power coupler that includes an input port, a first output port and a second output port is integrated within the printed circuit board structure, wherein the antenna element is electrically coupled to an isolation port of the power coupler.

11. The printed circuit board structure of claim 10, wherein the patch radiating element includes a patch radiator that is part of the conductive pattern, and wherein the patch radiator has an inset feed.

12. The printed circuit board structure of claim 10, wherein the power coupler comprises a four port power coupler that includes the isolation port.

13. The printed circuit board structure of claim 10, wherein at least a portion of the power coupler is implemented as a substrate integrated waveguide that includes an array of plated through holes that connect the conductive ground plane to the conductive pattern.

14. The printed circuit board structure of claim 10, wherein at least a portion of the power coupler is implemented as a co-planar waveguide that includes an array of plated vias that connect the conductive ground plane to first and second ground portions of the conductive pattern, the conductive pattern further including a conductive track that is separated from the first and second ground portions by respective first and second gaps.

15. A substrate integrated waveguide power coupler, comprising:

an input port;

a first output port;

a second output port;

an isolation port;

a coupling region that is between the input port and the first and second output ports and that is between the isolation port and the first and second output ports; and an antenna element that is electrically coupled to the isolation port opposite the first and second output ports;

wherein the power coupler is configured to split a radio frequency ("RF") signal incident at the input port and/or to combine radio signals incident at the respective first and second output ports.

16. The substrate integrated waveguide power coupler of claim 15, wherein the antenna element comprises a patch radiating element.

17. The substrate integrated waveguide power coupler of claim 15, wherein the power coupler is implemented in a printed circuit board that includes a dielectric substrate, a conductive ground plane on a first surface of the dielectric substrate and a conductive pattern on a second surface of the dielectric substrate that is opposite the first surface, and first and second rows of plated holes that connect the conductive ground plane to the conductive pattern, the first and second rows of plated holes lining respective first and second sides of the coupling region.

18. A power coupler, comprising:

an input port;

a first output port;

a second output port;

a first coupling transmission line coupled between the input port and the first output port;

a second coupling transmission line coupled between the input port and the second output port; and an antenna element having a first port that is electrically coupled to the first coupling transmission line and a second port that is electrically coupled to the second coupling transmission line;

wherein the power coupler is configured to split a radio frequency ("RF") signal incident at the input port and/or to combine radio signals incident at the respective first and second output ports.

19. The power coupler of claim 18, wherein impedances of the first and second coupling transmission lines are higher than impedances of the first and second output ports.

20. The power coupler of claim 18, wherein the power coupler comprises a Wilkinson power divider.

* * * * *